US007949140B2

(12) United States Patent
Kino

(10) Patent No.: US 7,949,140 B2
(45) Date of Patent: May 24, 2011

(54) SOUND MEASURING APPARATUS AND METHOD, AND AUDIO SIGNAL PROCESSING APPARATUS

(75) Inventor: Yasuyuki Kino, Tokyo (JP)

(73) Assignee: Sony Corporation, Tokyo (JP)

( * ) Notice: Subject to any disclaimer, the term of this patent is extended or adjusted under 35 U.S.C. 154(b) by 1253 days.

(21) Appl. No.: 11/542,846

(22) Filed: Oct. 4, 2006

(65) Prior Publication Data

US 2007/0086597 A1 Apr. 19, 2007

(30) Foreign Application Priority Data

Oct. 18, 2005 (JP) ..... 2005-302984

(51) Int. Cl.
*H04R 29/00* (2006.01)

(52) U.S. Cl. ..... 381/58; 381/59; 700/94

(58) Field of Classification Search ..... 381/56–59, 381/96, 61, 63, 91, 92, 122, 17, 103; 700/94
See application file for complete search history.

(56) References Cited

U.S. PATENT DOCUMENTS 7,158,643 B2 * 1/2007 Lavoie et al. ..... 381/58
7,477,750 B2 * 1/2009 Yoshino ..... 381/59

FOREIGN PATENT DOCUMENTS

JP 04-295727 10/1992
JP 6-110465 A 4/1994
JP 07-095684 4/1995
JP 11-258034 * 9/1999
JP 11-258034 A 9/1999
JP 2000-097763 4/2000
JP 2000-134688 A 5/2000
JP 2001-25100 A 1/2001
JP 2004-193782 A 7/2004
JP 2007-113943 A 5/2007

OTHER PUBLICATIONS

Nobuharu Aoshima, "Computer-generated Pulse Signal Applied for Sound Measurement", J. Acoust. Soc. Am., No. 69(5), 1981.
Yoiti Suzuki et al., "An Optimum Computer-generated Pulse Signal Suitable for the Measurement of Very Long Impulse Responses", J. Acoust. Soc. Am. 97(2), 1995.
Yoiti Suzuki et al., "Considerations on the Design of Time Stretched Pulses", Technical Report of IEICE. EA92-86 (Dec. 1992).

* cited by examiner

*Primary Examiner* — Vivian Chin
*Assistant Examiner* — Lun-See Lao
(74) *Attorney, Agent, or Firm* — Wolf, Greenfield & Sacks, P.C.

(57) ABSTRACT

A sound measuring apparatus for measuring a sound-arrival delay time from a speaker to a microphone on the basis of a result obtained by outputting a test signal from the speaker and picking up the test signal using the microphone includes the following elements. A control unit performs control so that the test signal is expanded in a time axis and is then output from the speaker. A delay time measuring unit measures an expansion-based measured delay time on the basis of a delay time that is measured on the basis of a time difference between the test signal expanded in the time axis and output from the speaker and a signal obtained from the microphone by picking up the output expanded test signal, and obtains the sound-arrival delay time as the expansion-based measured delay time.

7 Claims, 14 Drawing Sheets

| FIG. 10A |
| --- |
| FIG. 10B |

SOUND MEASURING APPARATUS AND METHOD, AND AUDIO SIGNAL PROCESSING APPARATUS

CROSS REFERENCES TO RELATED APPLICATIONS

The present invention contains subject matter related to Japanese Patent Application JP 2005-302984 filed in the Japanese Patent Office on Oct. 18, 2005, the entire contents of which are incorporated herein by reference.

BACKGROUND OF THE INVENTION

1. Field of the Invention

The present invention relates to sound measuring apparatuses and methods and to audio signal processing apparatuses. More specifically, the present invention relates to a sound measuring apparatus and method for measuring a sound-arrival delay time from a speaker to a microphone on the basis of a result obtained by outputting a test signal from the speaker and picking up the test signal using the microphone. The present invention further relates to an audio signal processing apparatus having a function for measuring the sound-arrival delay time.

2. Description of the Related Art

In audio systems of the related art, in particular, an audio system in which audio signals are output from multiple channels, a test signal such as a sine-wave or time stretched pulse (TSP) signal is output from a speaker, and is picked up by a microphone located at a different place from the speaker. The result is used to measure a delay time (sound-arrival delay time) until the sound output from the speaker arrives at the microphone.

FIG. 12 shows an example technique of the related art.

In FIG. 12, a TSP signal is used as the test signal. As well known in the art, the TSP signal is generated by shifting the phase of an impulse signal shown in FIG. 12. Thus, the TSP signal output from the speaker and picked up by the microphone is subjected to a fast Fourier transform (FFT) and phase conversion so that the phase is shifted back by an amount of phase shift determined for generating the TSP signal, followed by an inverse fast Fourier transform (IFFT), to obtain an impulse response.

The thus obtained impulse response includes information on the delay time until the sound output from the speaker arrives at the microphone. Specifically, if the distance between the speaker and the microphone is not zero, a rising position of the impulse response obtained from the picked up TSP signal is delayed behind a rising position of an impulse signal that the TSP signal to be output from the speaker is based on, and the difference between the rising position of the impulse response and the rising position of the impulse signal is measured to determine the sound-arrival delay time (namely, a delay time DT shown in FIG. 12).

In view of the foregoing description, referring to FIG. 12, first, a TSP signal is output from a speaker for a predetermined period of time, as indicated by an output signal shown in FIG. 12, so that the TSP signal is repeatedly output for a plurality of cycles.

A microphone starts to pick up the TSP signal, as indicated by a picked up audio signal shown in FIG. 12, after the lapse of a predetermined time from the start of the output of the TSP signal. The microphone also picks up the TSP signal for the predetermined period of time so that the TSP signal of the plurality of cycles can be picked up.

The start of the pickup operation is synchronized with the beginning of one cycle of the TSP signal obtained as the output signal in the manner shown in FIG. 12. As shown in FIG. 12, since the speaker starts to output the TSP signal from the beginning of one cycle, the pickup operation is started in synchronization with the beginning of one cycle of the TSP signal, thus allowing a phase shift between the output TSP signal and the picked up TSP signal to be easily obtained by measuring the rising position of the impulse response calculated from the picked up audio signal starting from the beginning (0th clock) of one cycle.

In the technique shown in FIG. 12, the phase shift between the output TSP signal and the picked up TSP signal is measured as the deviation of the rising position of the impulse response described above.

Specifically, first, the picked up TSP signal of the plurality of cycles is added and averaged in the manner shown in FIG. 12. The adding and averaging operation relatively reduces the level of noise that is not synchronized with the cycles, such as background noise, and increases the signal-to-noise (S/N) ratio of the measured response signal. The result of the adding and averaging operation is subjected to FFT, phase conversion, and IFFT, as described above, to obtain an impulse response, and the deviation between the rising position of the obtained impulse response and the rising position of the original impulse signal that has not been output is measured to measure the sound-arrival delay time, namely, the delay time DT shown in FIG. 12.

Since the pickup operation starts in synchronization with the beginning of the output TSP signal, the measurement of the delay time DT based on the obtained impulse response is actually performed by determining which clock the impulse response rises at.

Techniques of the related art are disclosed in Japanese Unexamined Patent Application Publications No. 2000-097763 and No. 04-295727.

SUMMARY OF THE INVENTION

Accordingly, a sound-arrival delay time from a speaker to a microphone can be measured using a test signal output from the speaker and a signal obtained by picking up the test signal using the microphone.

However, such a test-signal-based measurement technique of the related art has a limitation in that a delay time whose length is up to only one cycle of the test signal can be measured.

In the technique of the related art shown in FIG. 12, as described above, the delay time is measured on the basis of the phase difference (time difference) between the output test signal and the picked up test signal. Thus, for example, as shown in FIG. 13, if the delay time is one cycle longer than that shown in FIG. 12, the same delay time can be obtained as the measurement result.

As can be understood from the above description, the technique of the related art shown in FIG. 12 does not allow accurate measurement of a delay time unless the length of the delay time is within one cycle of the test signal. That is, the technique of the related art can only be used in the case where it is known in advance that the length of the delay time will be within one cycle (that is, in the case where it is known in advance that the distance between the speaker and microphone will be within a distance corresponding to a delay time corresponding to one cycle).

Since the measurable delay time is limited to within one cycle of the test signal, one of the current approaches for allowing measurement of a longer delay time is to increase the number of samples of the test signal.

Actually, the test signal is output from the speaker so that values of the test signal are output one-by-one according to a constant clock (for example, 44.1 kHz). If the number of samples of the test signal increases, the time length of one cycle of the test signal can become long correspondingly. Therefore, a longer delay time can be measured.

However, as the number of samples of the test signal increases, the amount of data as the test signal also increases, leading to an increase in the capacity of a memory for storing the test signal data. Therefore, the above-described approach is not suitable for memory-resource-limited apparatuses.

Furthermore, in particular, when a TSP signal is used as the test signal, an increase in the number of samples increases the number of samples in the FFT and IFFT operations for measuring an impulse response, leading to a large processing load. Also in this point of view, the above-described approach is not suitable for hardware-resource-limited apparatuses.

It is therefore desirable to measure a sound-arrival delay time from a speaker to a microphone on the basis of a result obtained by outputting a test signal from the speaker and picking up the test signal using the microphone, in which a measurable delay time is not limited by the hardware resource of the apparatus.

According to an embodiment of the present invention, a sound measuring apparatus for measuring a sound-arrival delay time from a speaker to a microphone on the basis of a result obtained by outputting a test signal from the speaker and picking up the test signal using the microphone includes control means for performing control so that the test signal is expanded in a time axis and is then output from the speaker.

According to another embodiment of the present invention, an audio signal processing apparatus having a sound measuring function for measuring a sound-arrival delay time from a speaker to a microphone on the basis of a result obtained by outputting a test signal from the speaker and picking up the test signal using the microphone includes control means for performing control so that the test signal is expanded in a time axis and is then output from the speaker.

The audio signal processing apparatus also includes delay time measuring means for obtaining the sound-arrival delay time as an expansion-based measured delay time on the basis of a delay time that is measured on the basis of a time difference between the test signal expanded in the time axis and output from the speaker and a signal obtained from the microphone by picking up the output expanded test signal.

The audio signal processing apparatus also includes delay time adjusting means for adjusting a delay time of an audio signal to be output from the speaker according to the sound-arrival delay time obtained by the delay time measuring means.

According to an embodiment of the present invention, by expanding a test signal in the time axis, a longer delay time can be measured. Thus, a long delay time can be measured regardless of the number of samples of the test signal.

According to an embodiment of the present invention, therefore, since the expansion of a test signal in the time axis allows measurement of a longer delay time, a long delay time can be measured regardless of the number of samples of the test signal.

Thus, in the measurement of a sound-arrival delay time from a speaker to a microphone based on a result obtained by outputting a test signal from the speaker and picking up the test signal using the microphone, there is no limit to a measurable delay time irrespective of the hardware resource of the apparatus.

Further, the audio signal processing apparatus according to the embodiment of the present invention can adjust a delay time of an audio signal to be output from the speaker according to the delay time measured using the technique of the embodiment of the present invention.

DESCRIPTION OF THE PREFERRED EMBODIMENTS

Embodiments of the present invention will be described.

Figure 1:
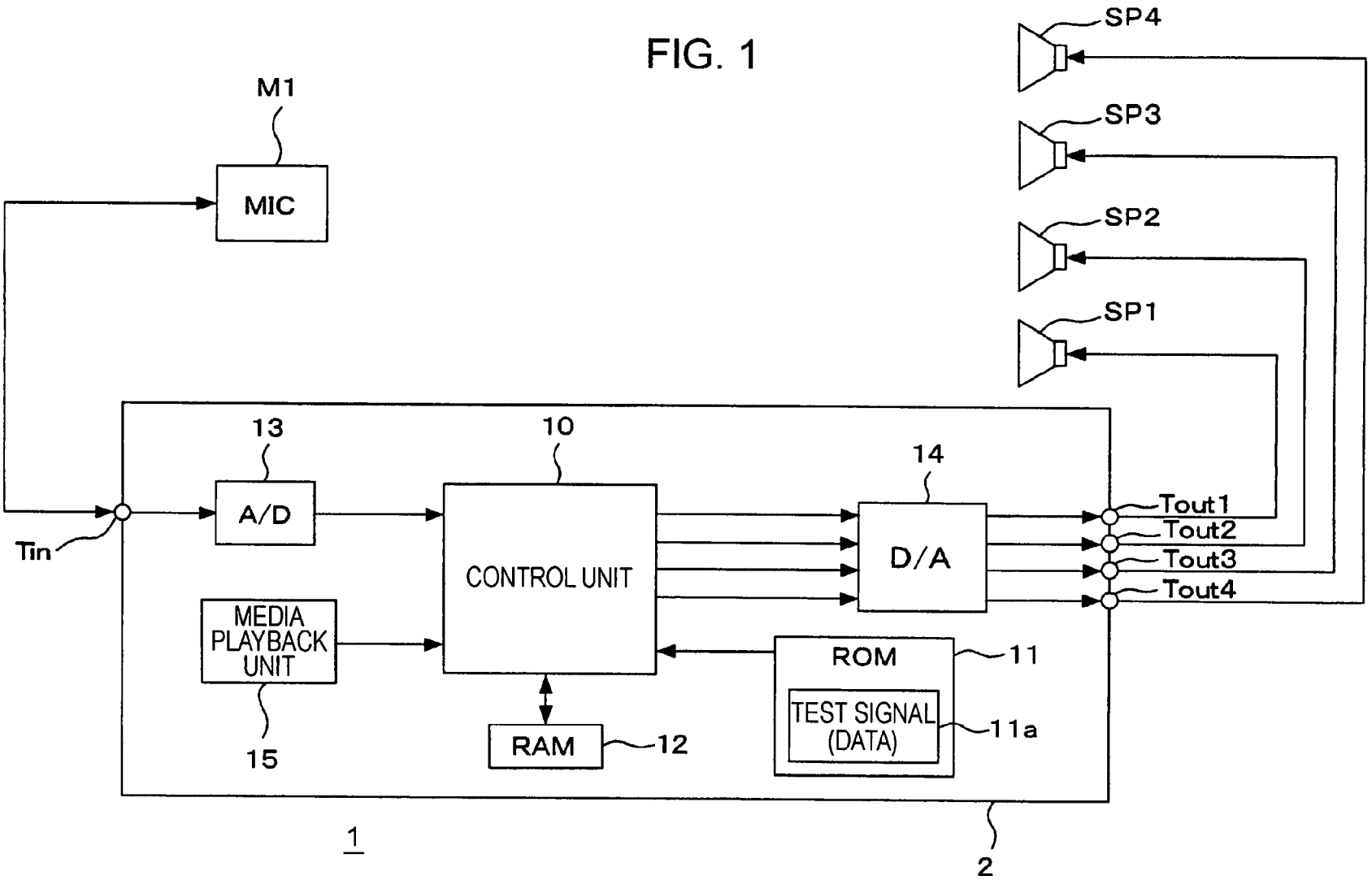
FIG. 1 is a block diagram showing an internal structure of an audio signal processing apparatus according to an embodiment of the present invention and a structure of an audio system including the audio signal processing apparatus, a speaker, and a microphone.

FIG. 1 is a diagram showing an internal structure of a playback apparatus 2, which is an audio signal processing apparatus according to an embodiment of the present invention, and a structure of an audio system 1 including the playback apparatus 2.

In FIG. 1, the playback apparatus 2 according to the embodiment includes a media playback unit 15 capable of playing back a desired recording medium, e.g., an optical disc recording medium such as a compact disc (CD), a digital versatile disc (DVD), or a Blu-Ray disc, a magneto-optical disc such as a Mini Disc (MD), a magnetic disc such as a hard disk, or a recording medium having a built-in semiconductor memory.

The audio system 1 according to the embodiment also includes a plurality of speakers SP (namely, SP1, SP2, SP3, and SP4) from which audio signals (sound signals) played back by the media playback unit 15 of the playback apparatus 2 are output. The audio system 1 further includes a microphone (MIC) M1 that is used for a delay time measurement process described below.

The audio system 1 according to the embodiment may be, for example, an automobile audio system or a 5.1 channel surround system.

While the four speakers SP are provided, they merely represent that the audio system 1 includes a plurality of speakers SP, and the number of speakers SP is not limited to four.

The playback apparatus 2 is provided with an audio input terminal Tin through which an audio signal picked up by the microphone M1 is input, and is connected to the microphone M1 through the audio input terminal Tin.

The playback apparatus 2 is also provided with a plurality of audio output terminals Tout1 to Tout4, the number of which corresponds to the number of speakers SP1 to SP4, and is connected to the speakers SP1 to SP4 through the audio output terminals Tout1 to Tout4.

The picked up audio signal that is input from the microphone M1 through the audio input terminal Tin is input to a control unit 10 through an analog-to-digital (A/D) converter 13.

A plurality of channels of audio signals, the number of which corresponds to the number of speakers SP, are supplied from the control unit 10 to the corresponding audio output terminals Tout1 to Tout4 through a digital-to-analog (D/A) converter 14.

The control unit 10 is formed of, for example, a digital signal processor (DSP) or a central processing unit (CPU), and achieves functional operations described below.

A read-only memory (ROM) 11 and a random access memory (RAM) 12 are provided for the control unit 10. The ROM 11 stores programs, coefficients, parameters, etc., used for the control unit 10 to perform various control operations. In the embodiment, the ROM 11 also stores a test signal 11*a* in the form of data, which is used for the delay time measurement process described below. In the embodiment, a time stretched pulse (TSP) signal is used as the test signal.

The RAM 12 temporarily stores working data of the control unit 10, and is used as a work area.

As described above, the media playback unit 15 plays back a recording medium.

For example, when the media playback unit 15 supports recording media such as optical disc recording media and MDs, the media playback unit 15 includes an optical head, a spindle motor, a playback signal processor, and a servo circuit, and applies laser light to a disc-shaped recording medium placed therein to play back a signal.

An audio signal obtained by the playback operation is supplied to the control unit 10.

Figure 2:
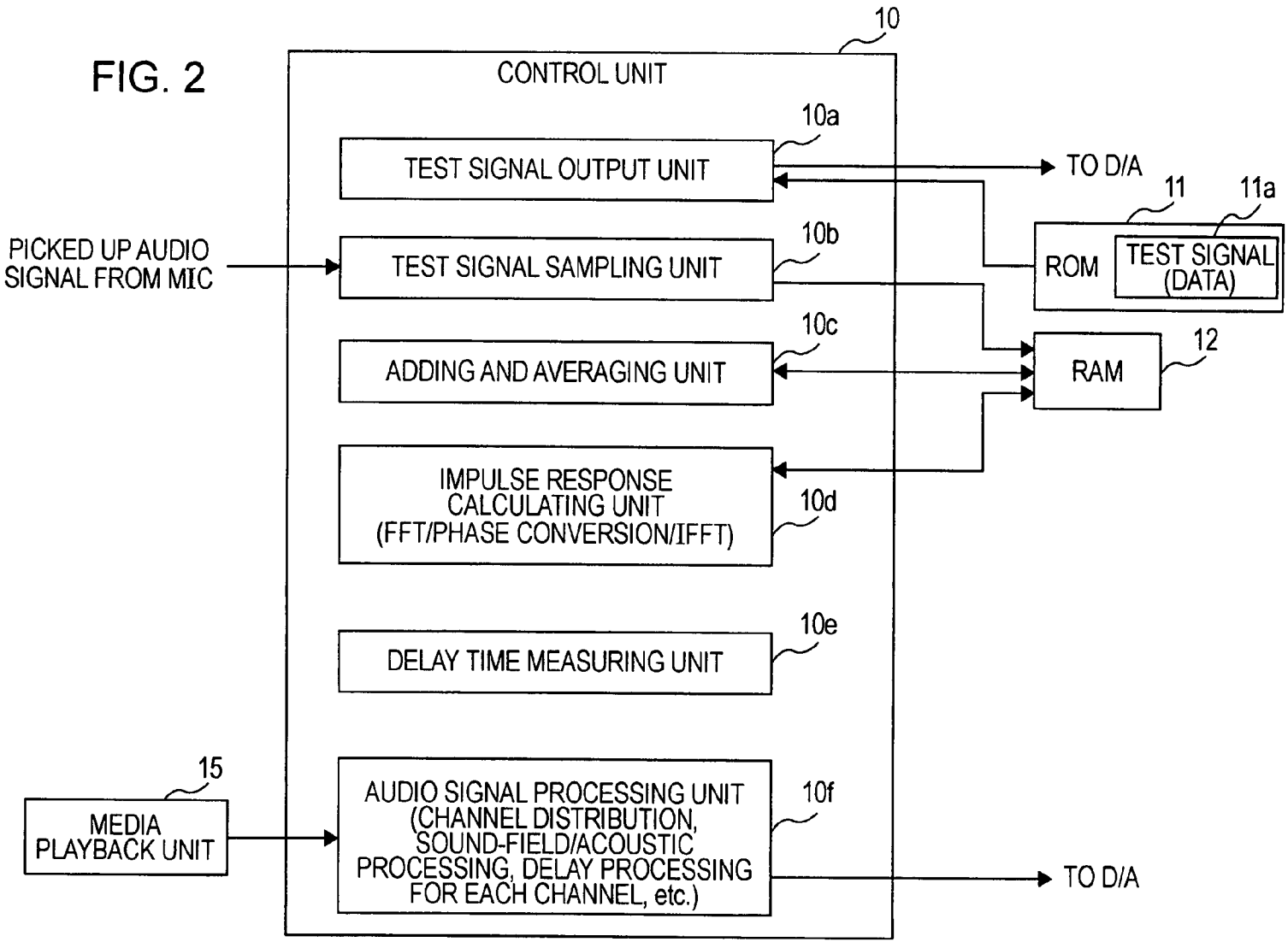
FIG. 2 is a diagram showing the functional operations achieved by a control unit in the audio signal processing apparatus according to the embodiment.

FIG. 2 is a diagram showing the functional operations achieved by the control unit 10. In FIG. 2, the functional operations achieved by the control unit 10 are illustrated as blocks. The media playback unit 15, the ROM 11, and the RAM 12 shown in FIG. 1 are also illustrated in FIG. 2.

In FIG. 2, the control unit 10 includes functions serving as a test signal output unit 10*a*, a test signal sampling unit 10*b*, an adding and averaging unit 10*c*, an impulse response calculating unit 10*d*, a delay time measuring unit 10*e*, and an audio signal processing unit 10*f*.

In the embodiment, the control unit 10 implements the functional operations by software processing. However, those functional blocks may be implemented by hardware.

The test signal output unit 10*a* outputs a test signal (in this case, a TSP signal), which is to be output from the speakers SP in the delay time measurement process described below, based on the test signal 11*a* stored in the form of data in the ROM 11. That is, values of the test signal 11*a* are sequentially output according to an operating clock. The output values of the test signal (TSP signal) are supplied to each of the speakers SP through the D/A converter 14 and the corresponding audio output terminal Tout shown in FIG. 1, and the speaker SP outputs as an actual sound an audio signal based on the test signal 11*a*.

Also in this case, the test signal is output for a predetermined period of time so that the test signal can be output for a plurality of cycles, as described below.

The delay time measurement process is performed for each of the speakers SP. The test signal output unit 10*a* can therefore output a test signal by switching the output depending on the speaker channel. That is, when the channel of the speaker SP1 is selected, the values of the test signal 11*a* are output to the line connected to the audio output terminal Tout1. When the channel of the speaker SP2 is selected, the values of the test signal 11*a* are output to the line connected to the audio output terminal Tout2. Likewise, the values of the test signal are output to the line connected to the audio output terminal Tout3 when the channel of the speaker SP3 is selected, and to the line connected to the audio output terminal Tout4 when the channel of the speaker SP4 is selected.

The test signal sampling unit 10*b* receives an audio signal that is picked up by the microphone M1 and that is supplied from the A/D converter 13 shown in FIG. 1 as a picked up audio signal with respect to the TSP signal output from each of the speakers SP, and samples the received audio signal according to an operating clock (for example, 44.1 kHz). The data as the sampled TSP signal (hereinafter also referred to as "TSP data") is stored in the RAM 12.

The picked up audio signal is also sampled for the predetermined period of time so that the test signal of the plurality of cycles can be obtained.

The adding and averaging unit 10*c* performs a synchronous adding and averaging operation on the TSP data of the plurality of cycles sampled and stored in the RAM 12. The TSP data subjected to the adding and averaging operation is also stored in the RAM 12.

The impulse response calculating unit 10*d* calculates an impulse response based on the TSP data subjected to the adding and averaging operation and stored in the RAM 12. The impulse response calculating unit 10*d* first performs a fast Fourier transform (FFT) on the TSP data. Then, the impulse response calculating unit 10*d* performs phase conversion on the FFT-processed TSP data so as to shift back the phase by an amount of phase shift determined for generating the TSP data, and thereafter performs an inverse fast Fourier transform (IFFT) to calculate an impulse response.

The delay time measuring unit 10*e* measures a delay time by measuring a deviation between the rising position of the calculated impulse response and the rising position of the impulse signal that the TSP signal stored as the test signal 11*a* is based on (that is, by measuring the number of delay samples).

Also in the embodiment, as described below, the TSP signal is output so that the impulse signal rises at the 0th clock, and the start of the sampling of the picked up audio signal is synchronized with the beginning of one cycle of the TSP signal to be output. Thus, the measurement of the delay time DT based on the calculated impulse response is actually performed by determining at which clock from the beginning of one cycle of the TSP signal the impulse response rises.

In the delay time measurement process of the embodiment, information on a delay time (a first delay time DT1) that is obtained by measuring (counting) the number of delay samples of the calculated impulse response is used to perform the processing described below (see FIG. 6 or 10), thereby obtaining information on a final delay time (a delay time DT2 or DT4 described below).

The audio signal processing unit 10*f* performs channel distribution processing, sound-field/acoustic processing, and delay processing for each channel, and so forth.

In the channel distribution processing, a plurality of audio signals input from the media playback unit 15 are distributed and output to the lines connected to the corresponding speakers SP (that is, the corresponding audio output terminals Tout). For example, when the audio system 1 is an automobile audio system, two (left and right) channels of audio signals played back from the media playback unit 15 are distributed and output to the lines connected to the speakers SP corresponding to the left and right channels (that is, the audio output terminals Tout corresponding to the left and right channels).

When the audio system 1 is a 5.1 channel surround system and is configured to play back two (left and right) channels of audio signals from the media playback unit 15, six channels of audio signals are generated from the two channels of audio signals so as to support 5.1 channels. The six channels of audio signals are distributed and output to the lines connected to the corresponding audio output terminals Tout.

The sound-field/acoustic processing includes processing for adding various sound effects using equalizing techniques, and processing for applying sound field effects such as digital reverb.

In the delay processing for each channel, the delay time DT (the delay time DT2 or DT4 described below) measured for each of the speakers SP (i.e., each channel) by the delay time measuring unit 10*e* is used to determine a delay time of an audio signal to be output from each of the speakers SP, and each of the audio signals is subjected to delay processing according to the determined delay time. That is, the delay time of each of the audio signals is adjusted according to the measured delay time DT.

The adjustment of the delay time for each channel is performed so that the sounds output from the speakers SP can arrive at the microphone M1 at the same time. Therefore, when the microphone M1 is located at a desired listening position, the sounds from the speakers SP can arrive at the listening position at the same time.

A specific technique for delaying and outputting audio signals output from the speakers SP according to the delay times individually measured for the speakers SP is not particularly limited herein, and may be any of various proposed techniques.

According to the foregoing description, also in the embodiment, a delay time is measured on the basis of a phase difference (time difference) between an output test signal and a picked up test signal.

However, as described previously, such a test-signal-based measurement technique has a limitation in that a delay time whose time length is up to only one cycle of the test signal can be measured.

Hence, one current approach for measuring a longer delay time is to increase the number of samples of the test signal, as described above.

However, as the number of samples of the test signal increases, the amount of data as the test signal also increases, leading to an increase in the capacity of a memory (in this case, the ROM 11) for storing the test signal data (the test signal 11*a*). Therefore, the above-described approach is not suitable for memory-resource-limited apparatuses.

Furthermore, in particular, when, as in this case, a TSP signal is used as the test signal, an increase in the number of samples increases the number of samples in the FFT and IFFT operations for calculating an impulse response, leading to a large processing load. Also in this point of view, the above-described approach is not suitable for hardware-resource-limited apparatuses.

Accordingly, in the embodiment, the test signal is expanded in the time axis and is then output from each of the speakers SP. The expansion in the time axis increases the time length of one cycle of the test signal. By expanding the test signal, a longer delay time can be measured.

Such a measurement technique will be described with respect to first and second embodiments of the present invention.

First Embodiment

Figure 3:
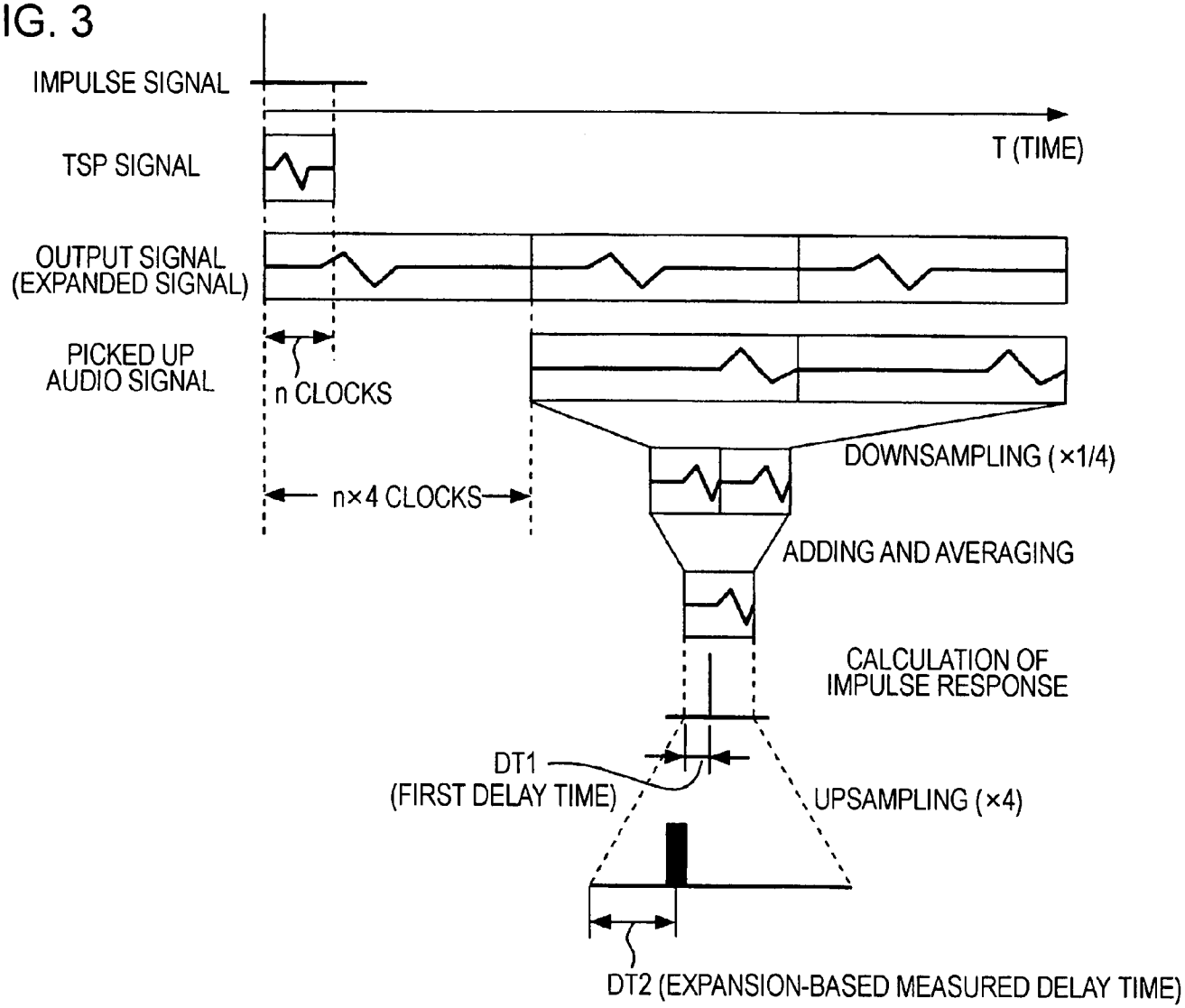
FIG. 3 is a diagram showing a delay time measurement process according to a first embodiment of the present invention.

FIG. 3 is a diagram showing a delay time measurement process according to the first embodiment.

In FIG. 3, the waveforms of a TSP signal, an impulse signal that the TSP signal is based on, an output signal that is output from each of the speakers SP based on the TSP signal according to the method of the first embodiment, and a picked up audio signal obtained by picking up the output signal using the microphone M1 are illustrated with respect to a time axis T.

Each of the waveforms shown in FIG. 3 is sectioned by frames, and each frame represents one cycle of a TSP signal as a test signal.

For the convenience of description, the delay time measurement process for one of the speakers SP will be described. The delay times for the speakers SP may be measured by repeatedly performing a similar measurement process for each of the speakers SP.

In FIG. 3, the waveform of the TSP signal is a waveform obtained when values of the TSP signal stored as the test signal 11*a* in the form of data in the ROM 11 shown in FIG. 1 (and FIG. 2) are output on a clock-by-clock basis. That is, the waveform of a TSP signal output according to an existing method is illustrated.

In the first embodiment, the output signal shown in FIG. 3 is obtained by expanding the TSP signal by factor of a predetermined number in the time axis. In this case, for example, the TSP signal is expanded by a factor of four in the time axis and is then output.

Figure 4A:
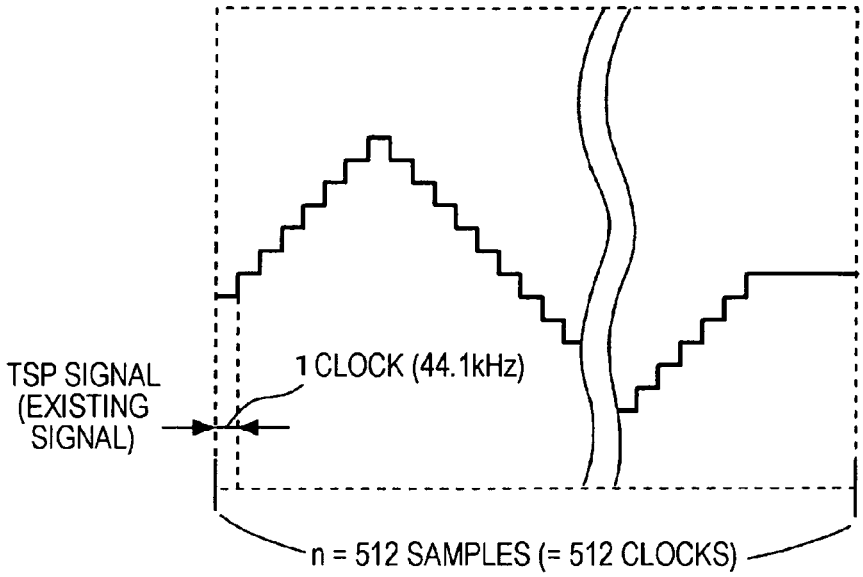
FIGS. 4A and 4B are diagrams showing a test signal that is output according to an existing method and an expanded output test signal, respectively.

For the sake of confirmation, a TSP signal that is output according to the existing method is shown in FIG. 4A. If the number of samples of the TSP signal stored as the test signal 11*a* is n, the values at the 0th through nth samples are output on a clock-by-clock basis.

As shown in FIG. 4A, it is assumed that the number of samples (n) of the TSP signal is 512. One cycle of the TSP signal has therefore a length of 512 clocks.

For example, If the operating clock is 44.1 kHz, the length of one cycle of the TSP signal is given by 512÷44100 (in seconds).

Figure 4B:
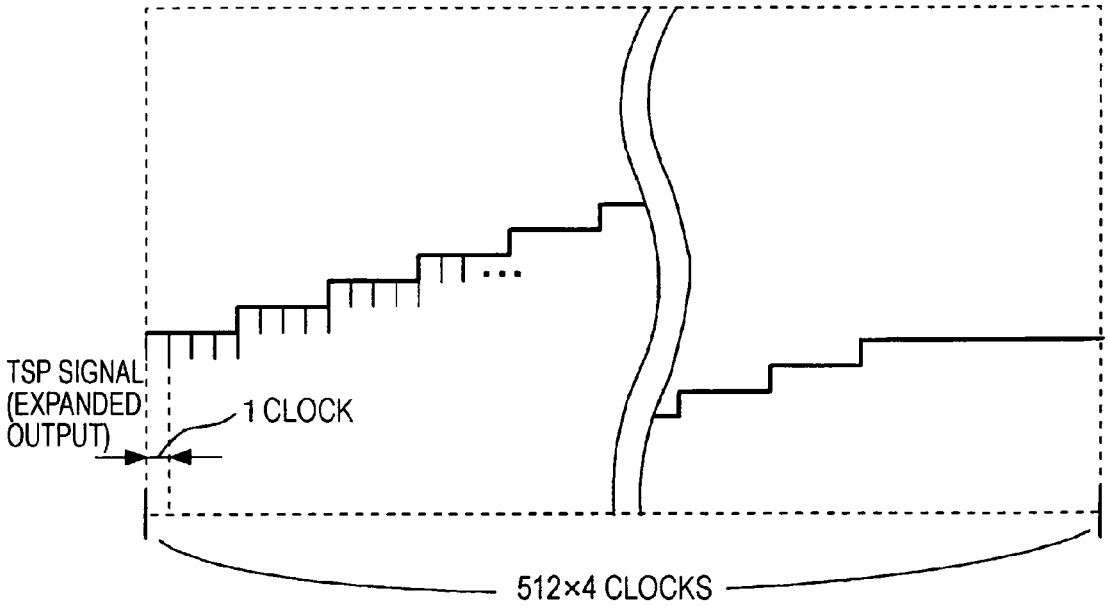

The TSP signal is expanded in the time axis, that is, in the first embodiment, as shown in FIG. 4B, the TSP signal (data) stored as the test signal 11*a* is upsampled and output. Specifically, the values of the TSP signal are output for a plurality of predetermined clocks in the manner shown in FIG. 4B.

In this case, the TSP signal is expanded by a factor of four in the time axis, and each of the values of the TSP signal is output for four clocks. As shown in FIG. 4B, one cycle of the TSP signal to be output has a length of 512×4 clocks, and the length of one cycle is given by 1048×44100 (in seconds) under an operating clock of 44.1 kHz.

Referring back to FIG. 3, as described above, the TSP signal is expanded in the time axis and is output for a predetermined time length so that the expanded signal can be output for a plurality of predetermined cycles. In FIG. 3, the expanded signal is output for three cycles.

While the expanded signal is output, the picked up audio signal is sampled in parallel. That is, the expanded signal output from the speaker SP and picked up by the microphone M1 is sampled.

The sampling of the picked up audio signal is started in synchronization with the beginning of one cycle of the expanded output signal. In FIG. 3, for the convenience of illustration, the timing of the start of the picked up audio signal and the timing of the beginning of the second cycle of the output signal (expanded signal) are synchronized with each other. Actually, as is to be understood, the microphone M1 starts to pick up the expanded signal from the speaker SP after the lapse of the time corresponding to the distance between the speaker SP and the microphone M1 (i.e., the sound-arrival delay time).

In the first embodiment, in the sampling operation, because the TSP signal has been expanded, the picked up audio signal is downsampled according to the factor by which the TSP signal is expanded. Specifically, in this case, since the TSP signal is expanded by a factor of four before being output, the picked up audio signal is downsampled to ¼. That is, the expanded signal obtained as the picked up audio signal is sampled once every four clocks. The length of one cycle of the resulting signal is therefore the same as the length (in this case, 512 clocks) of one cycle of the original signal that has not been expanded and output.

The downsampling of the picked up audio signal is also performed for the predetermined period of time so that the plurality of cycles of the expanded signal obtained as the picked up audio signal can be downsampled. In the example shown in FIG. 3, two cycles of the expanded signal obtained as the picked up audio signal are subjected to the downsampling processing, and the TSP signal of two cycles is obtained.

When an expanded signal of a plurality of cycles that is obtained as a picked up audio signal is downsampled to obtain a TSP signal of a plurality of cycles, the TSP signal of the plurality of cycles is subjected to synchronous adding and averaging processing to obtain a TSP signal of one cycle.

Then, an impulse response is calculated from the TSP signal obtained by the adding and averaging processing. As described above with respect to the impulse response calculating unit 10*d* shown in FIG. 2, the TSP data as a result of the adding and averaging processing is subjected to FFT and phase conversion so that the phase of the TSP data is shifted back by an amount of phase shift with respect to the impulse signal that the TSP signal is based on, and is then subjected to IFFT to calculate an impulse response.

When the impulse response is calculated, a deviation between the rising position of the calculated impulse response and the rising position of the impulse signal that the TSP signal output from the speaker SP is based on is measured to measure the delay time DT1 (first delay time) shown in FIG. 3.

In the first embodiment, the picked up audio signal is downsampled according to the expansion factor in the manner described above to obtain the TSP signal having the same length of one cycle as the original TSP signal that has not been output. Thus, the calculated impulse response and the impulse signal of the original TSP signal that has not been output are compared as usual to measure the delay time DT1.

The thus measured delay time DT1 has a value that reflects the amount of delay obtained with respect to the length of one cycle of the expanded TSP signal (namely, 512×4 clocks). However, the delay time DT1 does not represent a delay time on a true scale because the delay time DT1 is determined based on the TSP signal downsampled in the manner described above. Specifically, the delay time DT1 represents a delay time on a scale of one quarter equal to the defined downsampling factor.

In the first embodiment, therefore, the measured delay time DT1 is multiplied (in FIG. 3, upsampled) according to the factor by which the TSP signal to be output is expanded. Specifically, in this case, the delay time DT1 is multiplied by four.

Thus, the delay time DT2 (expansion-based measured delay time) can be obtained on a scale based on the length of one cycle of the expanded TSP signal. In the first embodiment, the delay time DT2 is obtained as final delay time information indicating the delay time until the sound output from the speaker SP arrives at the microphone M1 (i.e., the sound-arrival delay time).

Comparing the measurement technique of the first embodiment with the existing measurement technique, as described above, the existing technique allows measurement of only a delay time up to a length corresponding to the number of samples of a TSP signal. In the example shown in FIG. 3, a delay time up to a time length of 512 clocks, which is based on the number of samples of the TSP signal, can be measured.

In the technique of the first embodiment, on the other hand, a delay time up to a time length four times the number of samples of the TSP signal can be measured. The factor by which the TSP signal is expanded is not limited to four, and may be, for example, five or ten, in which case a delay time of a length five times or ten times can be measured using a similar technique. According to the first embodiment, therefore, a longer delay time can be measured according to the factor by the TSP signal to be output is expanded.

Accordingly, since the expansion of a TSP signal in the time axis allows measurement of a longer delay time, a long delay time can be measured regardless of the number of samples of the TSP signal.

Thus, in the measurement of a sound-arrival delay time from a speaker to a microphone based on a result obtained by outputting a TSP signal from the speaker and picking up the TSP signal using the microphone, there is no limit to a measurable delay time irrespective of the hardware resource of the apparatus.

A processing operation for implementing the measurement process of the first embodiment described above will be described with reference to flowcharts of FIGS. 5 and 6.

Figure 5:
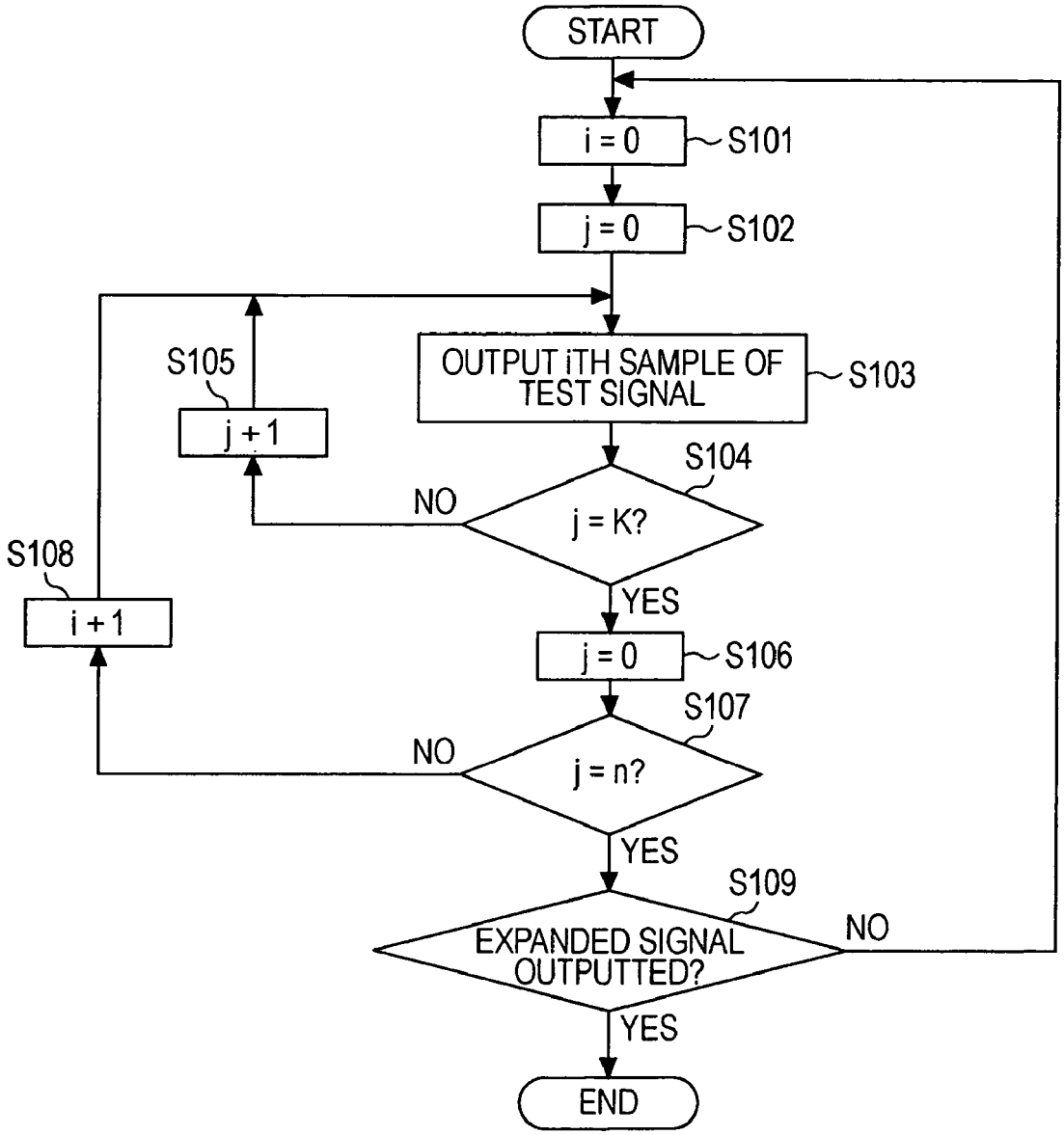
FIG. 5 is a flowchart showing a processing operation to be performed as the delay time measurement process according to the first embodiment when a test signal (expanded signal) is output.
Figure 6:
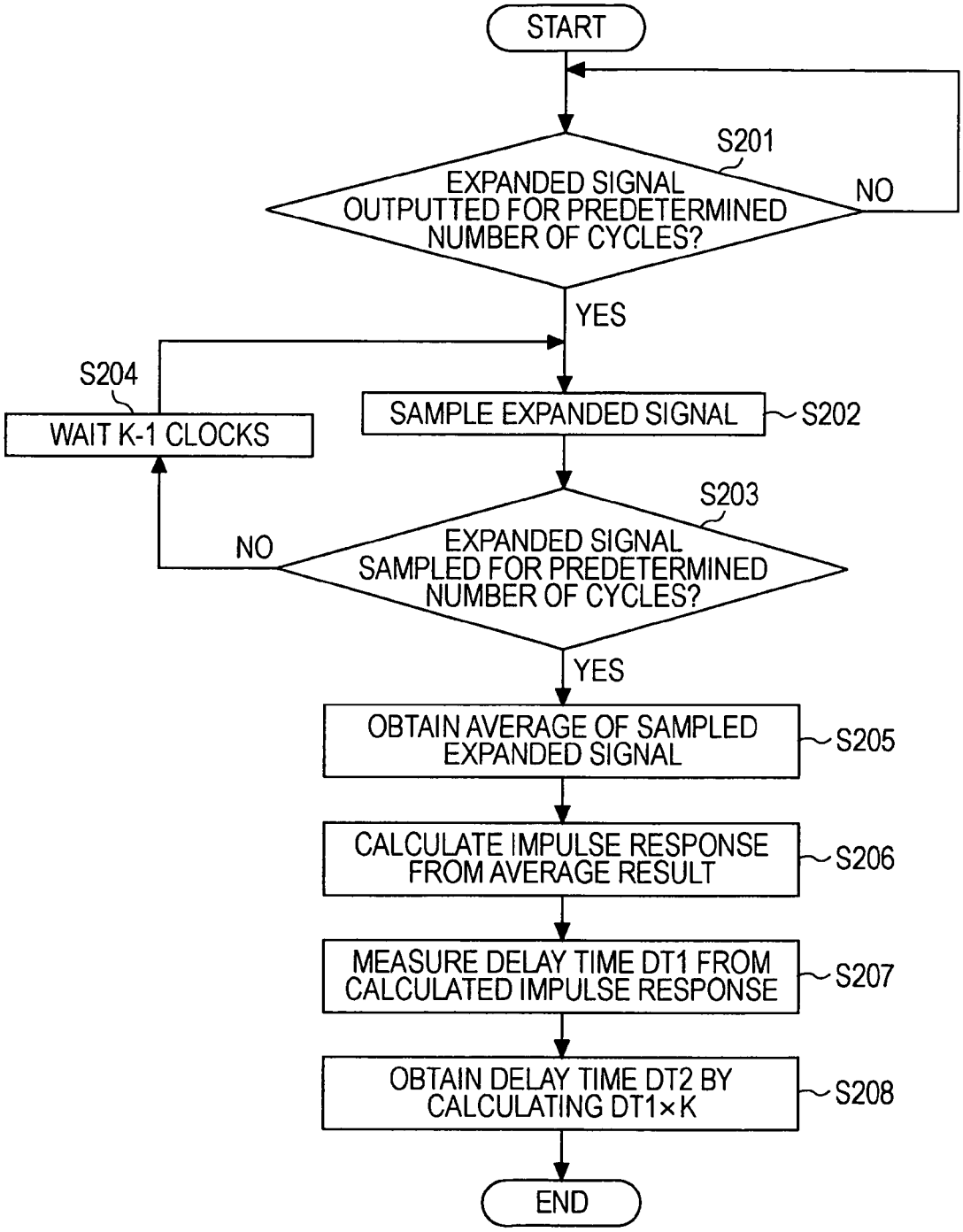
FIG. 6 is a flowchart showing a processing operation to be performed as the delay time measurement process according to the first embodiment during a period from when a picked up audio signal is sampled until a delay time (expansion-based measured delay time) is obtained.

The processing operation shown in FIGS. 5 and 6 is performed by the control unit 10 shown in FIG. 1 (and FIG. 2) according to a program stored in, for example, the ROM 11.

FIG. 5 shows a processing operation to be performed as the delay time measurement process according to the first embodiment when a test signal (expanded signal) is output.

The processing operation shown in FIG. 5 corresponds to the operation of the test signal output unit 10*a* in the functional blocks shown in FIG. 2.

Referring to FIG. 5, first, in step S101, an output-value-identification count value i is reset to 0. The output-value-identification count value i is a value for identifying which sample of the test signal 11*a* stored in the form of data in the ROM 11 is to be output in step S103 below.

In step S102, a number-of-outputs-identification count value j is reset to 0. The number-of-outputs-identification count value j is a value for identifying how many times one of the values of the test signal output in step S103 has been output.

In step S103, the ith sample of the test signal is output. That is, among the values of the TSP signal (data) stored as the test signal 11*a* in the ROM 11, the value specified by the output-value-identification count value i is output to the D/A converter 14 shown in FIG. 1.

In step S104, a determination is performed as to whether or not the number-of-outputs-identification count value j is equal to a factor value K. The factor value K represents a factor by the TSP signal is expanded, and is set to four in the example shown in FIG. 3 described above.

If the number-of-outputs-identification count value j is not equal to the factor value K and a negative result is obtained, the process proceeds to step S105, and the number-of-outputs-identification count value j is counted up (i.e., j+1). Then, the process returns to step S103, and the ith sample of the test signal is output again. By repeatedly performing the processing of steps S104, S105, S103, and then S104, the values of the test signal (TSP signal) are output for a plurality of clocks according to the factor value K.

If an affirmative result indicating that the number-of-outputs-identification count value j is equal to the factor value K is obtained in step S104, the process proceeds to step S106, and the number-of-outputs-identification count value j is reset to 0. Then, in step S107, a determination is performed as to whether or not the output-value-identification count value i is equal to a sample value n.

The sample value n is a value indicating the number of samples of the test signal 11*a*. In step S107, therefore, it is determined whether or not the TSP signal has been output for one cycle, in other words, whether or not all the values of the TSP signal have been output.

If a negative result indicating that the output-value-identification count value i is not equal to the sample value n is obtained in step S107, the process proceeds to step S108, and the output-value-identification count value i is counted up (i.e., i+1). Then, the process returns to step S103, and the ith sample of the test signal is output again.

If an affirmative result indicating that the output-value-identification count value i is equal to the sample value n is obtained in step S107, then, in step S109, a determination is performed as to whether or not the output of the expanded signal is to be terminated.

As described above with reference to FIG. 3, in the first embodiment, the expanded signal is output for a plurality of cycles (in this case, three cycles). In step S109, a determination is performed as to whether or not the expanded signal has been output for a predetermined number of cycles.

If a negative result indicating that the number of cycles of the expanded signal that has been output does not reach the predetermined number of cycles is obtained in step S109, as shown in FIG. 5, the process returns to step S101, the expanded signal is output for another cycle. That is, the expanded signal is output for the next one cycle.

If an affirmative result indicating that the number of cycles of the expanded signal that has been output reaches the predetermined number of cycles is obtained in step S109, the outputting process shown in FIG. 5 ends.

FIG. 6 shows a processing operation to be performed as the delay time measurement process according to the first embodiment during a period from when a picked up audio signal is sampled until a delay time (expansion-based measured delay time) is obtained.

For the sake of confirmation, the processing operation shown in FIG. 6 is performed in parallel with the processing operation shown in FIG. 5. The processing operation shown in FIG. 6 corresponds to the operation of the test signal sampling unit 10*b*, the adding and averaging unit 10*c*, the impulse response calculating unit 10*d*, and the delay time measuring unit 10*e* in the functional blocks shown in FIG. 2.

Referring to FIG. 6, first, in step S201, the process waits for an expanded signal to be output for a predetermined number of cycles. If the expanded signal is output for the predetermined number of cycles, then, in step S202, the expanded signal is sampled. That is, a picked up audio signal picked up by the microphone M1 and input through the A/D converter 13 is sampled.

As described above with reference to FIG. 3, in the first embodiment, the sampling of the picked up audio signal is started in synchronization with the beginning of one cycle of the expanded signal to be output. Specifically, the sampling is synchronized with the beginning of the second cycle of the expanded signal to be output (i.e., the (512×4+1)th clock).

As described above, in step S201, the process waits for an expanded signal to be output for a predetermined number of cycles (in this case, one cycle), and thereafter, the sampling is started in step S202. This allows the sampling of the picked up audio signal (expanded signal) to be started in synchronization with the beginning of one cycle of the expanded output signal.

In the first embodiment, the sampling of the picked up audio signal is started in synchronization with the beginning of one cycle of the expanded signal to be output. Thus, a delay time based on a calculated impulse response (i.e., the delay time DT1) can be easily measured merely by measuring the number of delay clocks from the beginning of the impulse response to the rising position.

However, in a case where such easiness is not taken into consideration, the start of the sampling of the picked up audio signal may not be necessarily synchronized with the beginning of one cycle of the expanded signal to be output. Even if the timing of the sampling and the timing of the beginning of one cycle are not synchronized with each other, once the amount of deviation between both timings is determined, the amount of deviation is added to (or subtracted from) a delay time that is measured in a similar manner from the beginning of the calculated impulse response, thereby obtaining the same measurement result.

In step S203, a determination is performed as to whether or not the expanded signal of the predetermined number of cycles has been sampled. That is, it is determined whether or not the expanded signal obtained as the picked up audio signal supplied from the A/D converter 13 has been sampled for the predetermined number of cycles.

According to the foregoing description with reference to FIG. 3, in this case, the expanded signal is sampled for two cycles. Thus, it is determined whether or not the expanded signal of two cycles has been sampled. Specifically, it is determined whether or not the (512×4×2)th clock from the start of the sampling has been sampled.

If a negative result indicating that the expanded signal of the predetermined number of cycles has not been sampled is obtained in step S203, then, in step S204, the process waits (K−1) clocks. Then, the process returns to step S202, and the expanded signal (picked up audio signal) is sampled again.

By performing the waiting processing of step S204, the downsampling operation described above with reference to FIG. 3 can be realized.

If an affirmative result indicating that the expanded signal of the predetermined number of cycles has been sampled is obtained in step S203, then, in step S205, the sampled expanded signal is subjected to the adding and averaging processing. That is, the adding and averaging operation is performed on the expanded signal (TSP signal) of the plurality of cycles that is obtained by the downsampling operation.

In step S206, an impulse response is calculated from the result of the adding and averaging operation. In step S207, a delay time DT1 is measured from the calculated impulse response. That is, the number of delay samples from the clock at the beginning of the calculated impulse response (i.e., the 0th clock) to the rise time of the calculated impulse response is measured.

In step S208, the delay time DT1 is multiplied by the factor value K to obtain a delay time DT2 as an expansion-based measured delay time.

While the delay time measurement process for one of the speakers SP has been described with reference to FIGS. 5 and 6, delay times DT2 for speakers are measured by sequentially selecting one of the plurality of speakers SP (namely, SP1 to SP4) and sequentially performing the processes shown in FIGS. 5 and 6 on the selected speaker SP. Thus, the delay times DT2 for the respective speakers SP can be obtained.

The thus obtained delay times DT2 for the respective speakers SP are used for the adjustment of a delay time for each speaker channel, which is performed by the control unit 10, as described above with respect to the delay processing for each channel by the audio signal processing unit 10*f* in FIG. 2. That is, the control unit 10 sets a delay time of an audio signal to be played back by the media playback unit 15 and to be output from each of the speakers SP according to the delay time DT2 measured for each of the speakers SP, and performs delay processing on the audio signals according to the set delay times.

The delay time for each channel is set so that the sounds from the speakers SP can arrive at the microphone M1 at the same time, as described above. Therefore, when the microphone M1 is located at a desired listening position, the sounds output from the speakers SP can arrive at the listening position at the same time.

In the foregoing description, the expansion factor by which a TSP signal as a test signal is expanded is fixed. However, the expansion factor may be variable.

For example, a user interface for setting an expansion factor may be provided so that the expansion factor can be set according to a user operation.

Figure 7:
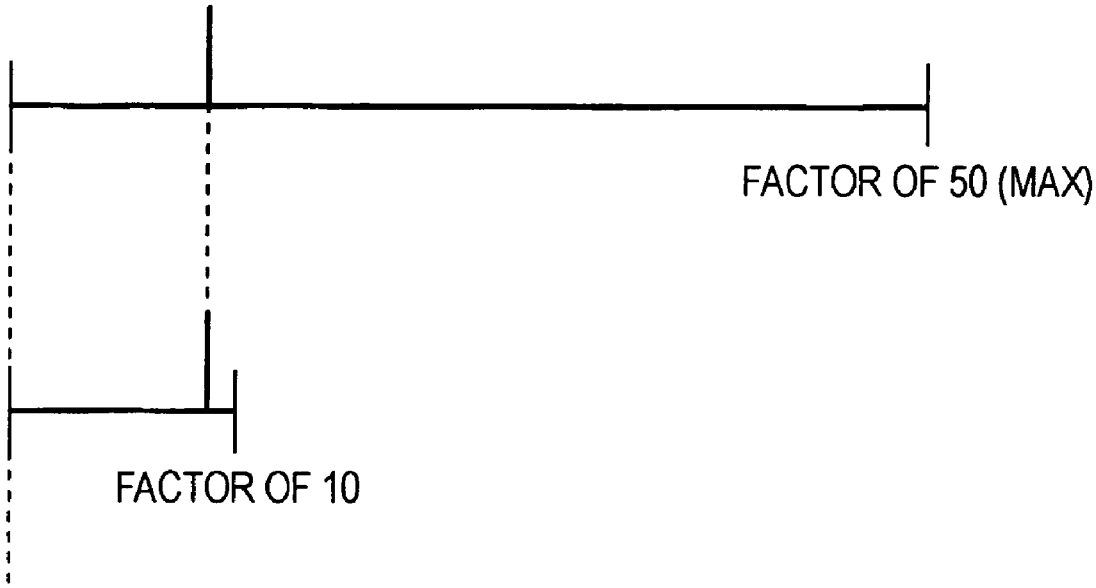
FIG. 7 is a diagram showing a modification of the first embodiment.

Alternatively, as shown in FIG. 7, first, a measurement may be performed with a predetermined high expansion factor, such as the maximum expansion factor (MAX), to determine a rough delay time, and a closer expansion factor that may be set again according to the result to perform a second measurement.

FIG. 7 shows delay times between the same speaker SP and the microphone M1, for example, a delay time DT2 measured with a factor of 50 and a delay time DT2 measured with a factor of 10, in the form of the expanded impulse response shown in FIG. 3.

According to the technique of the first embodiment, the higher the expansion factor, the longer the measurable delay time (that is, the longer the distance between the speaker and the microphone), whereas the higher the expansion factor, the lower the measurement accuracy. This is because in order to determine the delay time DT2 according to the first embodiment, the delay time DT1 measured on the basis of the downsampled result is multiplied and returned by an amount corresponding to the expansion factor.

Taking these characteristics into account, as described above, first, a rough delay time is determined with a high expansion factor, and a more precise delay time is then measured with a closer expansion factor according to the result, thus allowing higher-accuracy measurement depending on the delay time determined at each time.

In order to achieve further higher-accuracy measurement, the operation of setting a closer expansion factor from the delay time obtained by the second measurement and performing another measurement with the set expansion factor may be repeatedly performed to finally measure a delay time with the closest expansion factor.

Second Embodiment

As described above, one effective technique for improving the measurement accuracy using the technique of the first embodiment is to set a closer expansion factor from a measurement result obtained with a high expansion factor and to perform another measurement with the set expansion factor. In any case, the finally measured delay time DT2 is obtained based on the expanded TSP signal, and it is difficult to provide high-accuracy measurement on a clock-by-clock basis, as in the existing method.

Accordingly, the second embodiment provides a technique capable of measuring a longer delay time according to the defined expansion factor according to the technique of the first embodiment and capable of providing high-accuracy measurement on a clock-by-clock basis according to the existing technique.

For easy understanding of the technique of the second embodiment, problems with the existing technique will be reconsidered. As previously described in comparison between FIGS. 12 and 13, the existing technique does not allow measurement of a delay time that exceeds one cycle of the test signal because it is difficult to specify at which cycle the delay time extends. In other words, a delay time whose length exceeds one cycle of the test signal would be measured with high accuracy in the existing technique if the cycle has been specified.

On the other hand, the technique of the first embodiment allows measurement of a long delay time whose length exceeds one cycle of the test signal although the measurement accuracy is low. That is, the information on the delay time (expansion-based measured delay time) measured according to the technique of the first embodiment can be used as information specifying at which cycle in the cycles of the test signal the delay time extends in the existing technique.

Figure 8:
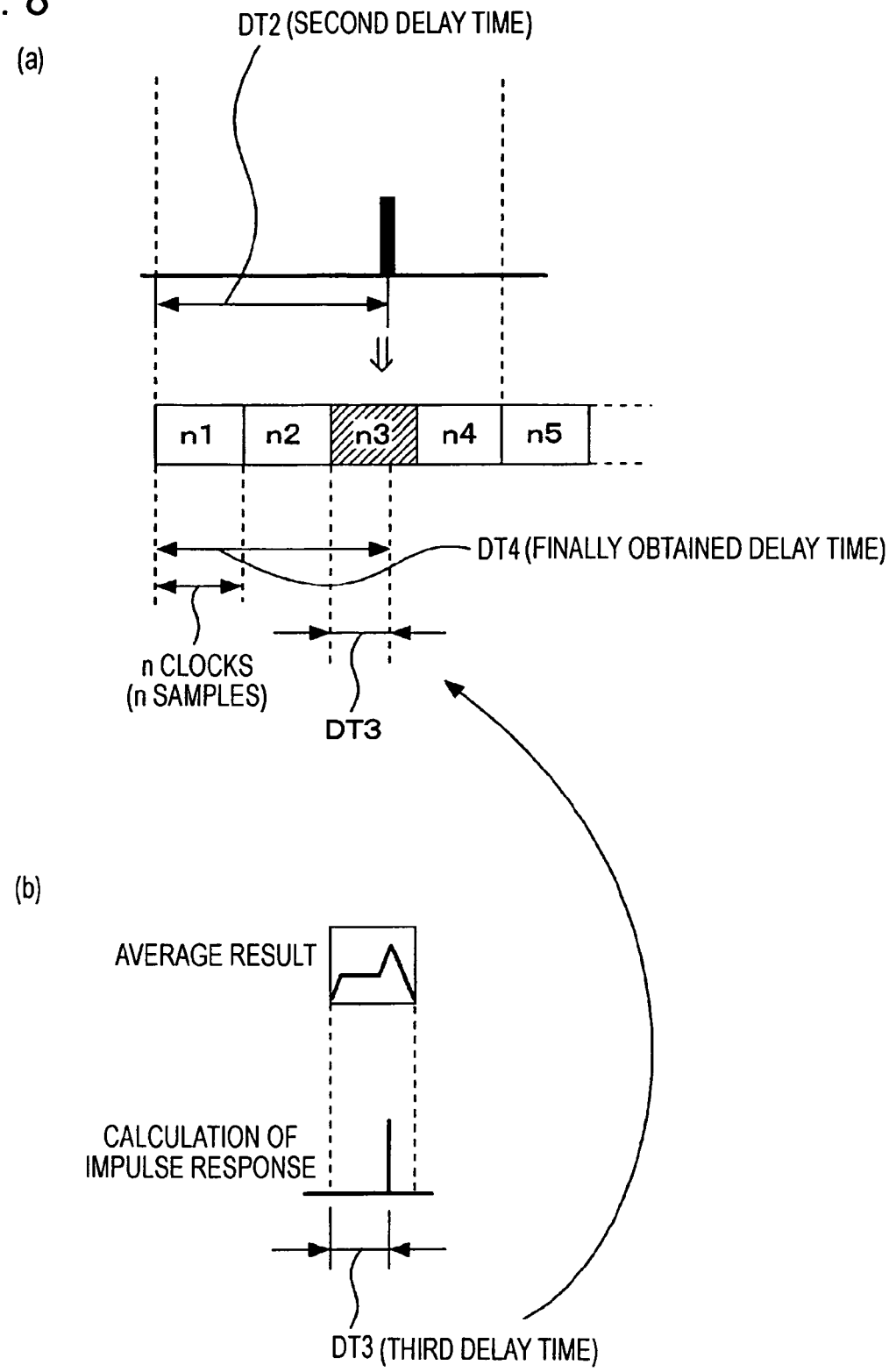
FIG. 8 is a diagram showing a delay time measurement process according to a second embodiment of the present invention.

In the second embodiment, therefore, as shown in FIG. 8, final delay time information is obtained using a combination of the technique of the first embodiment and the existing technique, thereby achieving both measurement of a longer delay time according to the defined expansion factor and high-accuracy measurement on a clock-by-clock basis.

First, in the measurement process of the second embodiment, as shown in (a) of FIG. 8, a delay time DT2 is obtained using the technique of the first embodiment described above. The delay time DT2 can be used to obtain rough information specifying at which cycle (in (a) of FIG. 8, which of cycles n1, n2, n3, n4, n5 . . . ) of a TSP signal the delay time extends in the case where the values of the TSP signal are output on a clock-by-clock basis (that is, in the case of the existing technique).

In (a) of FIG. 8, the measured delay time DT2 specifies that the delay time extends to the third cycle (namely, n3) of the TSP signal.

As well as the measurement of the delay time DT2 according to the first embodiment, a delay time DT3 (hereinafter referred to as a "normally measured delay time") is measured according to the existing measurement technique in the manner shown in (b) of FIG. 8.

Figure 13:
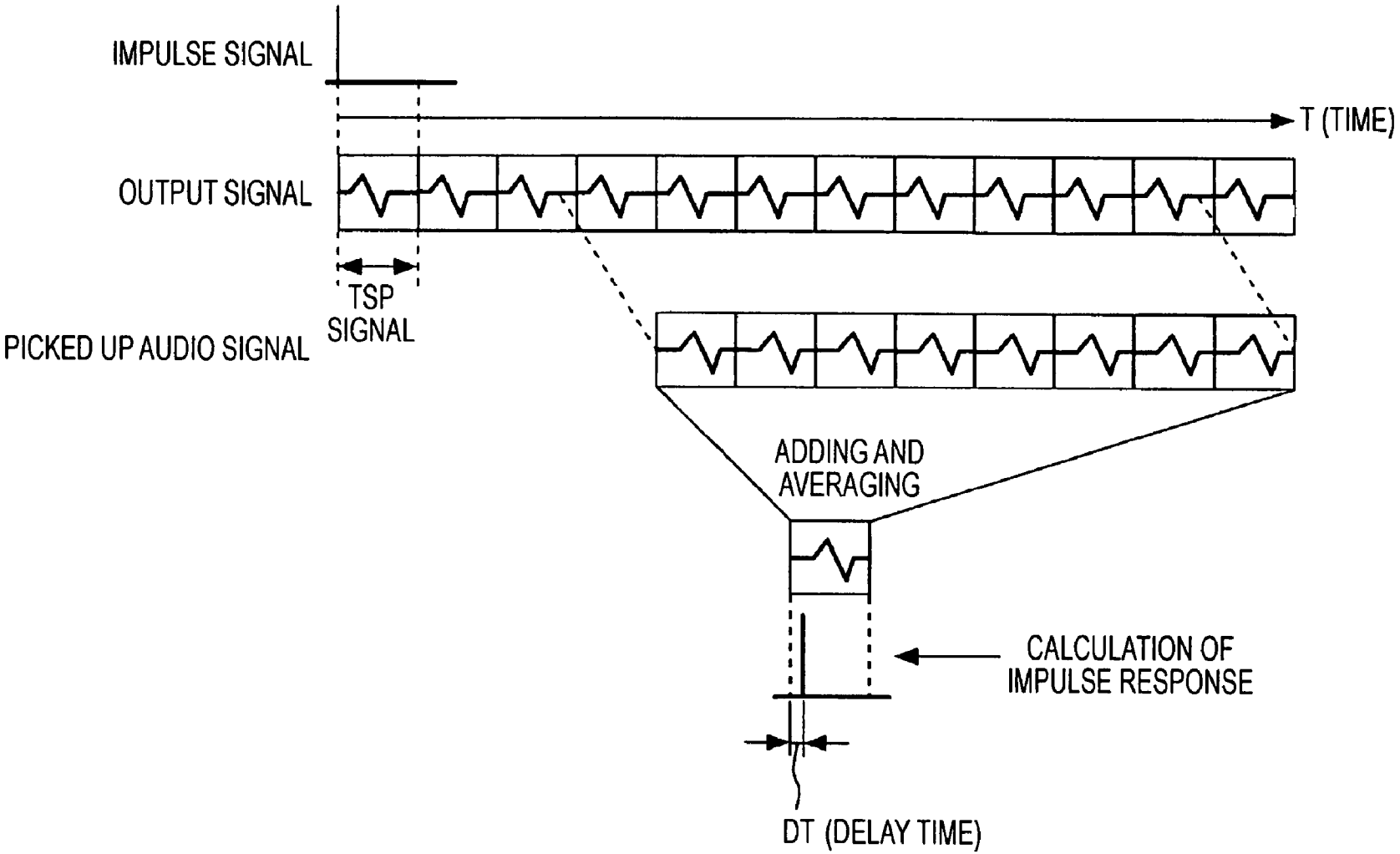
FIG. 13 is a diagram showing the relationship between an output signal and a picked up audio signal when the length of the delay time is one cycle of a test signal longer than that shown in FIG. 12.

In (b) of FIG. 8, in the existing measurement process shown in FIG. 13, only the operation of calculating an impulse response from a result of the adding and averaging operation and measuring a delay time from the calculated impulse response is extracted and illustrated.

The delay time DT3 measured using the existing technique and the information specifying at which cycle the delay time DT2 extends, which is obtained in (a) of FIG. 8, are used to determine the final delay time (delay time DT4) indicating a sound-arrival delay time from the speaker SP to the microphone M1.

In this case, since the third cycle of the TSP signal is specified by the delay time DT2, the number of clocks corresponding to the delay time DT2 is added to the number of clocks up to, for example, the second cycle previous to the third cycle to obtain the delay time DT4 as the sound-arrival delay time.

Therefore, the delay time DT2 measured using the technique of the first embodiment (i.e., the expansion-based measured delay time) and the delay time DT3 measured using the existing technique (i.e., the normally measured delay time) can be used to obtain the delay time DT4 as the final sound-arrival delay time.

Figure 9:
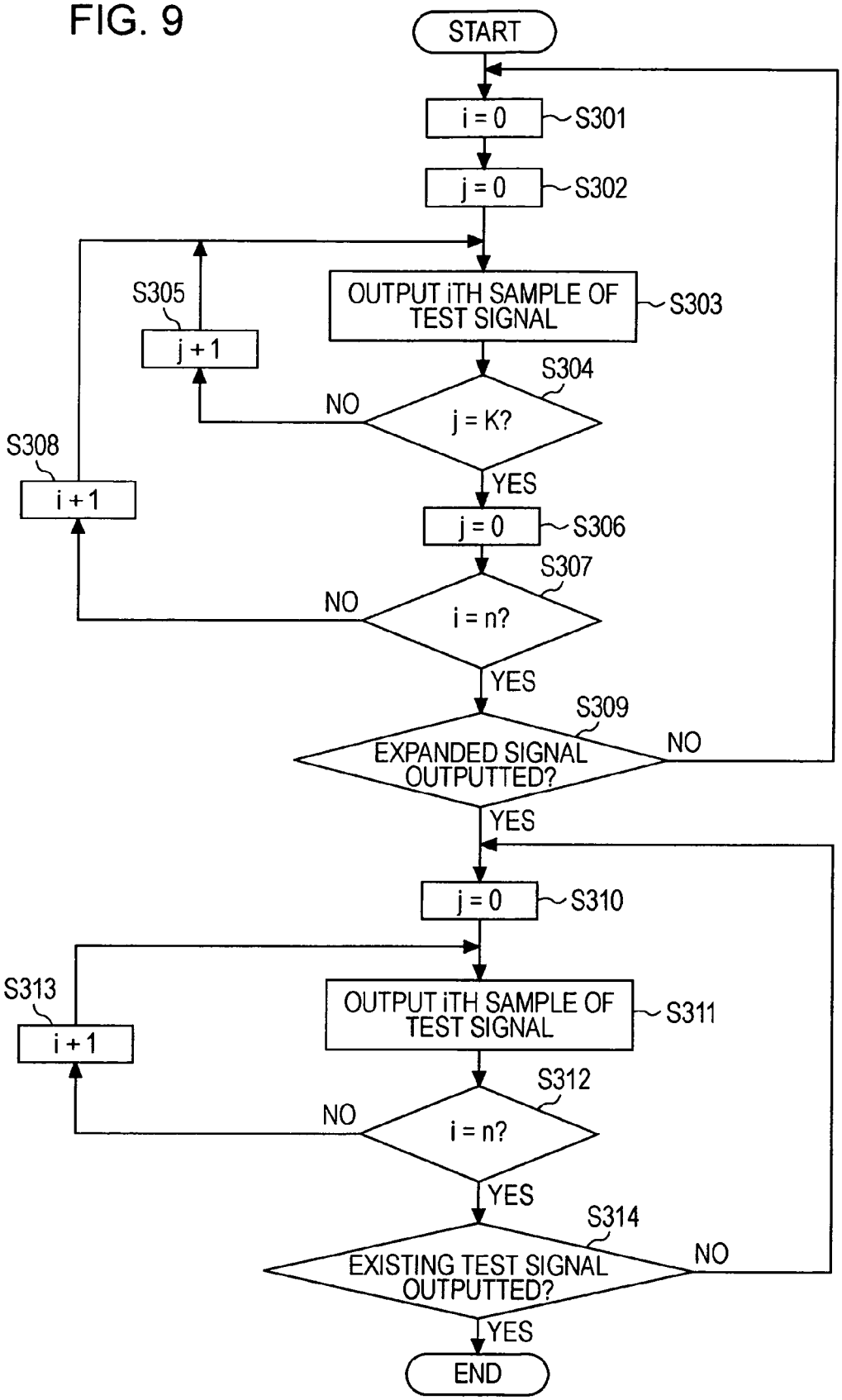
FIG. 9 is a flowchart showing a processing operation to be performed as the delay time measurement process according to the second embodiment when a test signal is output.
Figures 10, 10A:
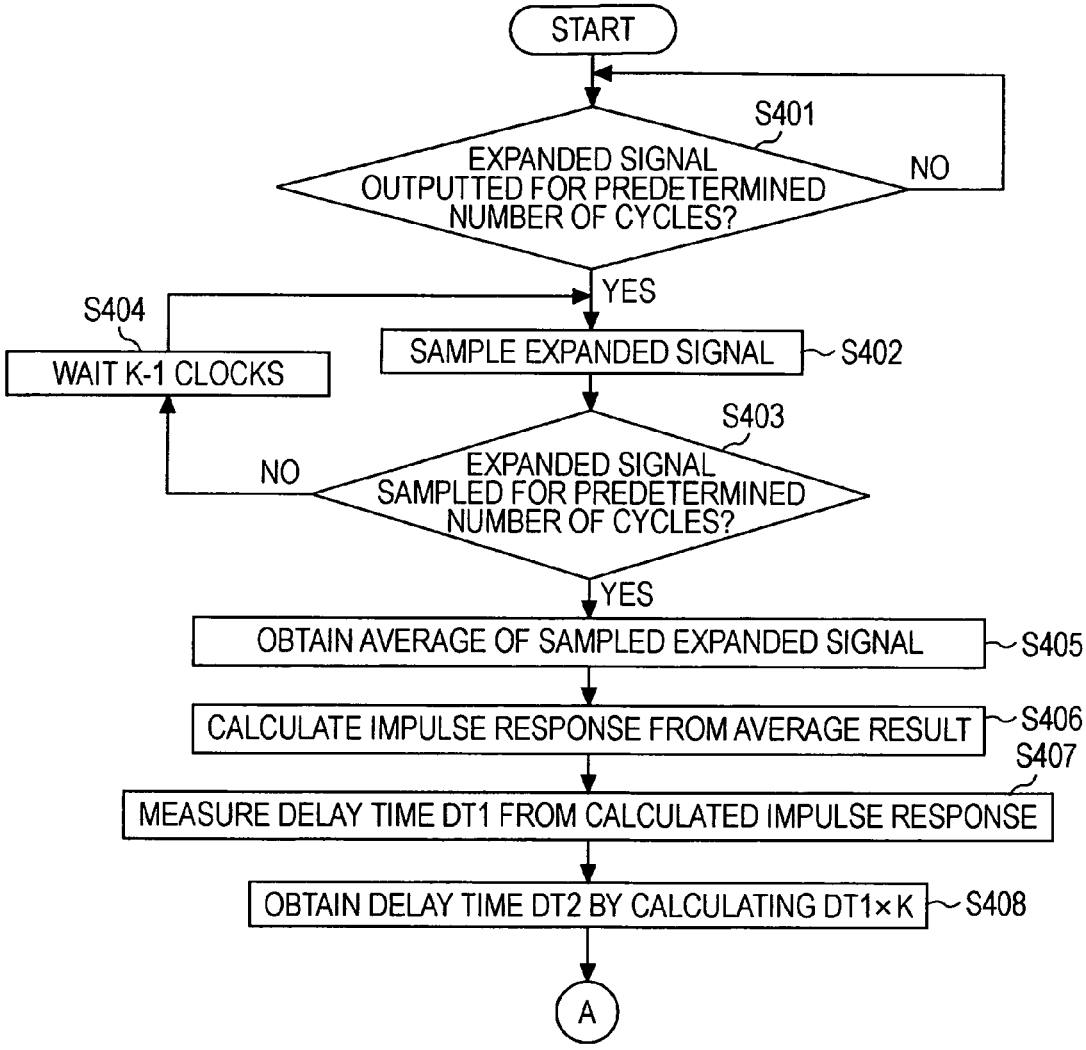
FIGS. 10A and 10B are flowcharts showing a processing operation to be performed as the delay time measurement process according to the second embodiment during a period from when a picked up audio signal is sampled until a delay time is obtained.

FIGS. 9 and 10 are flowcharts showing a processing operation for implementing the measurement process of the second embodiment described above. The processing operation shown in FIGS. 9 and 10 is also performed by the control unit 10 shown in FIG. 1 (and FIG. 2) according to a program stored in, for example, the ROM 11.

FIG. 9 shows a processing operation to be performed as the delay time measurement process according to the second embodiment when a test signal is output.

In the second embodiment, as described above, both the measurement process of the first embodiment and the existing measurement process are performed. Thus, the processing operation performed when a test signal is output according to the second embodiment is implemented by performing a process for outputting an expanded signal (namely, the processing of steps S301 to S309) corresponding to the process of the first embodiment shown in FIG. 5, and a process for outputting a test signal (TSP signal) in the related art.

The processing of steps S301 to S309 is similar to the processing of steps S101 to S109 shown in FIG. 5, and a description thereof is thus omitted.

In FIG. 9, in the determination processing of step S309, if the output of the expanded signal according to the technique of the first embodiment is to be terminated and an affirmative result is obtained, the process proceeds to step S310, and the output-value-identification count value i is reset to 0. As described above, the output-value-identification count value i is a value for identifying which sample of the test signal 11*a* (TSP data) is to be output.

In step S311, the ith sample of the test signal is output. That is, among the values of the TSP signal stored as the test signal 11*a* in the ROM 11, the value specified by the output-value-identification count value i is output to the D/A converter 14 shown in FIG. 1.

In step S312, a determination is performed as to whether or not the output-value-identification count value i is equal to a sample value n. Also, the sample value n is a value indicating the number of samples of the test signal 11*a*. In step S312, therefore, it is determined whether or not the TSP signal has been output for one cycle, in other words, whether or not all the values of the TSP signal have been output.

If a negative result indicating that the output-value-identification count value i is not equal to the sample value n is obtained in step S312, the process proceeds to step S313, and the output-value-identification count value i is counted up (i.e., i+1). Then, the process returns to step S311, and the ith sample of the test signal is output again.

By repeatedly performing the processing of steps S311, S312, S313, and then S311, the values of the TSP signal as the test signal 11*a* can be output on a clock-by-clock basis. That is, the TSP signal is output using the existing technique without being expanded.

If an affirmative result indicating that the output-value-identification count value i is equal to the sample value n is obtained in step S312, then, in step S314, a determination is performed as to whether or not the output of the test signal according to the existing technique is to be terminated.

Figure 12:
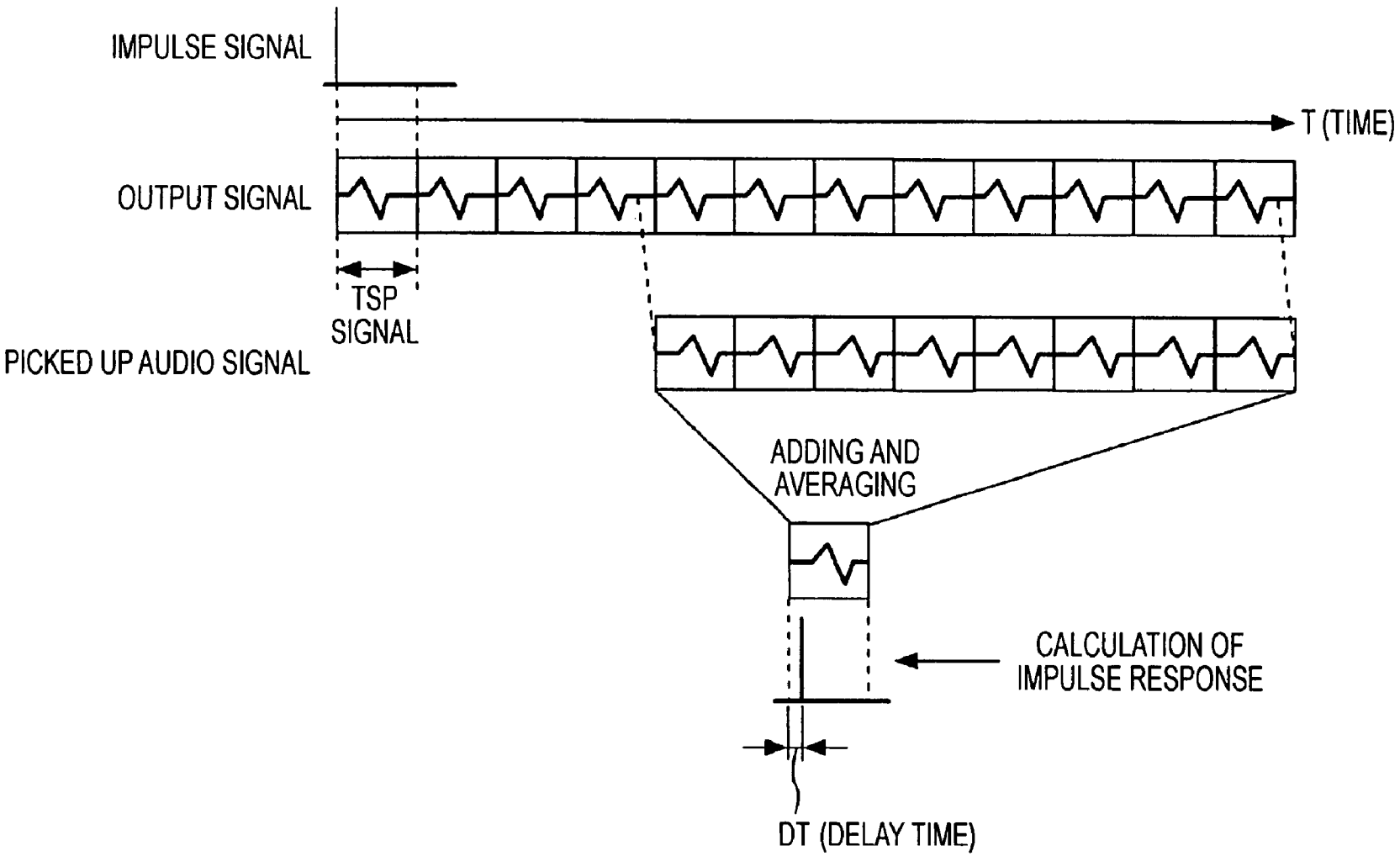
FIG. 12 is a diagram showing a delay time measurement process of the related art.

In the second embodiment, as in the output of the expanded signal, the output of the test signal on a clock-by-clock basis according to the existing technique is also performed for a plurality of predetermined cycles (in this case, 12 cycles, as shown in FIG. 12). In step S314, a determination is performed as to whether or not the output of the test signal according to the existing technique has been performed for a predetermined number of cycles.

If a negative result indicating that the number of cycles of the test signal that has been output does not reach the predetermined number of cycles is obtained in step S314, as shown in FIG. 9, the process returns to step S310, and the test signal is output for another cycle.

If an affirmative result indicating that the number of cycles of the test signal that has been output reaches the predetermined number of cycles is obtained in step S314, the outputting process shown in FIG. 9 ends.

Figure 10B:
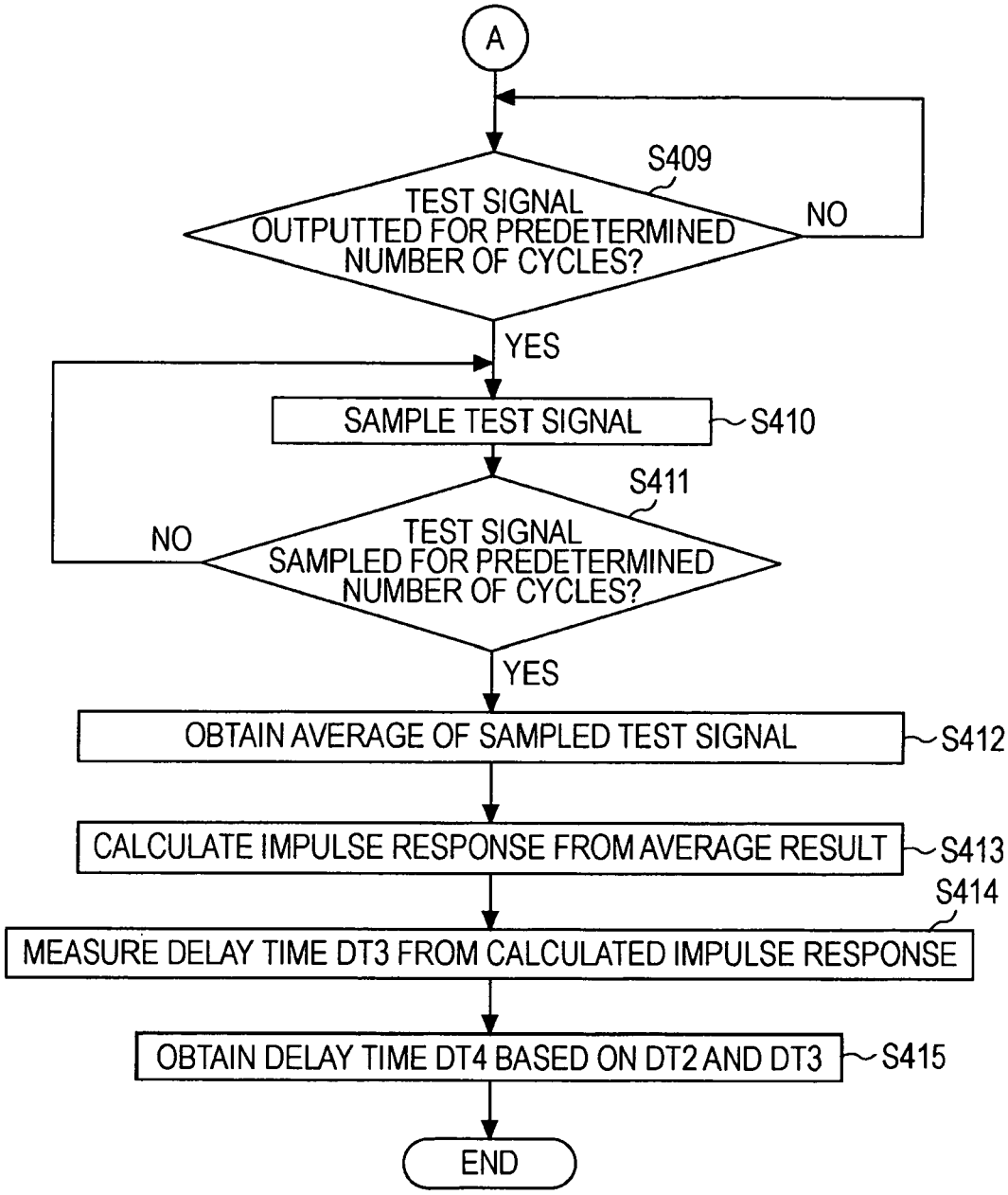

FIGS. 10A and 10B show a processing operation to be performed as the delay time measurement process according to the second embodiment during a period from when a picked up audio signal is sampled until a delay time is obtained. The processing operation shown in FIGS. 10A and 10B is performed in parallel with the processing operation shown in FIG. 9.

The processing operation to be performed on an expanded signal during the period from when the picked up audio signal is sampled until the delay time DT2 is measured (namely, the processing of steps S401 to S408) is similar to the processing of steps S201 to S208 shown in FIG. 6, and a description thereof is thus omitted. In FIGS. 10A and 10B, a process to be performed after the delay time DT2 is obtained in step S408 (i.e., the processing of steps S409 to S415) will be described.

The processing of steps S409 to S414 corresponds to the processing operation to be performed during a period from when a test signal output for a plurality of predetermined cycles using the existing technique is sampled in steps S310 to S314 shown in FIG. 9 until the delay time DT3 is measured, that is, the existing delay time measurement process.

First, in step S409, the process waits for a test signal to be output for a predetermined number of cycles. If the test signal is output for the predetermined number of cycles, then, in step S410, the test signal (specifically, the picked up audio signal) is sampled.

Also in the second embodiment, the sampling of the test signals output using the existing technique is started in synchronization with the beginning of one cycle of the test signal to be output. Specifically, as in the example shown in FIG. 12, the sampling is synchronized with the beginning of the fifth cycle of the test signal to be output (i.e., the (512×4+1)th clock).

As described above, in step S409, the process waits for a test signal to be output for a predetermined number of cycles (in this case, four cycles), and thereafter, the sampling is started in step S410. This allows the sampling of the picked up audio signal to be started in synchronization with the beginning of one cycle of the test signal output according to the existing method.

Also in the existing output process, the start of the sampling of the test signal may not be necessarily synchronized with the beginning of one cycle of the test signal to be output. The reason is similar to that described above with respect to the timing at which the sampling of the expanded signals is started.

In step S411, a determination is performed as to whether or not the test signal of the predetermined number of cycles has been sampled. That is, it is determined whether or not the test signal obtained as the picked up audio signal supplied from the A/D converter 13 has been sampled for the predetermined number of cycles.

Also in this case, for example, as in FIG. 12, the test signal (TSP signal) output according to the existing technique is sampled for eight cycles. In step S411, therefore, it is determined whether or not the test signal of eight cycles has been sampled (specifically, it is determined whether or not the (512×8)th clock from the start of the sampling has been sampled).

If a negative result indicating that the test signal of the predetermined number of cycles has not been sampled is obtained in step S411, the process returns to step S410, and the test signal (picked up audio signal) is sampled again.

That is, the test signal whose values are output on a clock-by-clock basis in the existing output process is sampled on a clock-by-clock basis (or is sampled in an existing manner).

If an affirmative result indicating that the test signal of the predetermined number of cycles has been sampled is obtained in step S411, then, in step S412, the sampled test signal is subjected to the synchronous adding and averaging processing.

In step S413, an impulse response is calculated from the result of the adding and averaging operation. In step S414, a delay time DT3 is measured from the calculated impulse response. Thus, the delay time DT3 (normally measured delay time) is measured using the existing delay time measurement process.

In step S415, the delay times DT2 and DT3 obtained in steps S408 and S414, respectively, are used to calculate a delay time DT4 as a final sound-arrival delay time. As described above, for example, the number of clocks corresponding to the delay time DT2 is added to the number of clocks up to the cycle previous to the cycle specified by the delay time DT2 to obtain the delay time DT4 as the sound-arrival delay time.

While the delay time measurement process for one of the speakers SP has been described with reference to FIGS. 9 and 10, delay times DT4 for speakers are measured by sequentially selecting one of the plurality of speakers SP and sequentially performing the processes shown in FIGS. 9 and 10 on the selected speaker SP. Thus, the delay times DT4 for the respective speakers SP can be measured.

The thus obtained delay times DT4 for the respective speakers SP are also used for the adjustment of a delay time for each speaker channel, which is performed by the control unit 10, as described above with respect to the delay processing for each channel in FIG. 2. That is, the control unit 10 sets a delay time of an audio signal to be played back by the media playback unit 15 and to be output from each of the speakers SP according to the delay time DT4 measured for each of the speakers SP, and performs delay processing on the audio signals according to the set delay times. Therefore, when the microphone M1 is located at a desired listening position, the sounds output from the speakers SP can arrive at the listening position at the same time.

In the second embodiment, furthermore, the delay times DT4 can be measured at a higher accuracy than the first embodiment. Therefore, the sounds output from the speakers SP can more accurately arrive at the listening position at the same time.

In the second embodiment, an expanded signal is output and sampled to measure the delay time DT2, after which the existing technique is performed, namely, a test signal is output on a clock-by-clock basis and is sampled to measure the delay time DT3, thereby measuring the final delay time DT4. Conversely, after the delay time DT3 is measured in the existing technique, the delay time DT2 may be measured based on the expanded output signal in the first embodiment, thereby measuring the final delay time DT4.

While embodiments of the present invention have been described, the present invention is not limited to the above-mentioned embodiments.

For example, in the above-mentioned embodiments, the same signal values are output for a plurality of predetermined clocks as an expanded output signal. Alternatively, different values may be output every a plurality of predetermined clocks (in the above-mentioned embodiments, every four clocks), and linear interpolation or zero-interpolation may be made between the remaining sections.

In any case, as far as a picked up audio signal is downsampled in the manner described above with respect to the embodiments, there is no difference from the case in which a TSP signal is expanded in the time axis and the resulting TSP signal is downsampled according to the expansion factor.

As shown in FIG. 4B, when a test signal is expanded by performing upsampling and is output, there is a concern that the expanded signal may contain high-frequency noise. Such a noise problem will be noticeable as the expansion factor increases.

Figure 11:
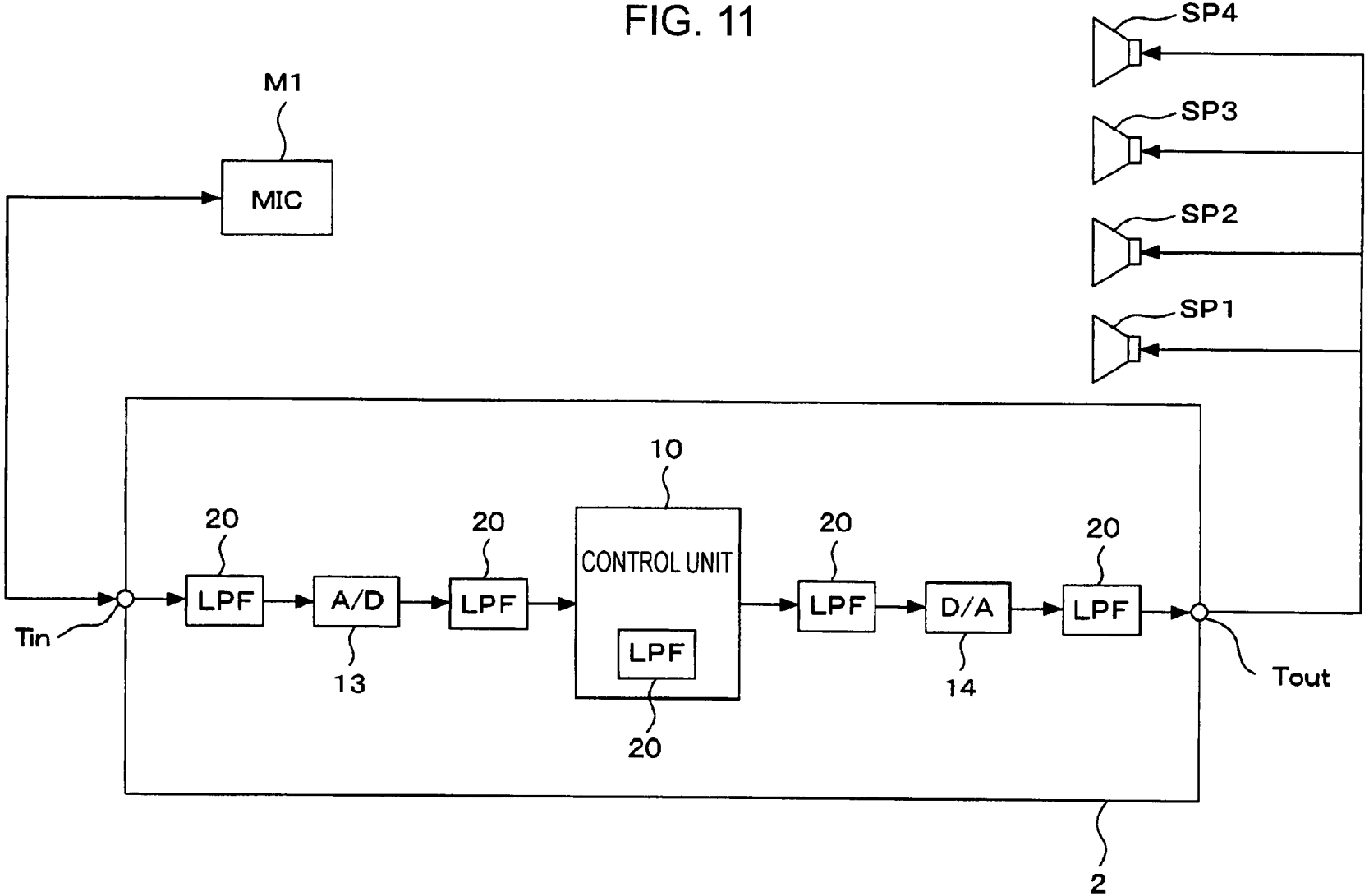
FIG. 11 is a block diagram showing a structure of an audio signal processing apparatus according to a modification of the embodiment.

Accordingly, as shown in FIG. 11, the playback apparatus 2 may further include a low-pass filter (LPF) 20 in the test signal outputting system or in the test signal picking up and sampling system. For example, the low-pass filter 20 is inserted between the audio input terminal Tin and the A/D converter 13, between the A/D converter 13 and the control unit 10, inside the control unit 10, between the control unit 10 and the D/A converter 14, or between the D/A converter 14 and the audio output terminal Tout.

Therefore, high-frequency noise caused in the expanded signal can be effectively suppressed, and a more accurate delay time DT2 (expansion-based measured delay time) can be obtained.

While in the embodiments, a TSP signal is used as the test signal, any other signal such as a pulse signal, a pseudo-random noise signal, or a sine wave signal may be used instead. That is, any signal that allows a sound-arrival delay time between a speaker and a microphone to be measured on the basis of a phase difference (time difference) between a signal output from the speaker and a signal obtained by picking up and sampling the output signal using the microphone can be used as the test signal of an embodiment of the present invention.

Specifically, when a test signal other than a TSP signal (e.g., a sine wave signal) is used, the delay time DT2 as the expansion-based measured delay time can be measured on the basis of a time difference between an expanded output test signal and a signal obtained by picking up the test signal and sampling the picked up audio signal according to the existing technique. In this case, there is no need for performing downsampling or multiplication according to the expansion factor, which is performed on a TSP signal.

Also when a test signal other than a TSP signal is used, as in the second embodiment, the delay time DT4 can be determined on a clock-by-clock basis with a high accuracy on the basis of the expansion-based measured delay time DT2 and the normally measured delay time DT3 measured using the existing technique.

While in FIG. 1, the media playback unit 15 is configured to play back audio signals from recording media, the media playback unit 15 may be configured as an amplitude modulation (AM) and frequency modulation (FM) tuner that receives and demodulates AM and FM broadcast signals and that outputs audio signals.

While the playback apparatus 2 is configured to perform playback processing (including reception and demodulation processing) on audio signals, the playback apparatus 2 may be configured to perform playback processing on both audio signals and video signals so as to support recording media storing audio and video signals, television broadcasting services, etc. In this case, the playback apparatus 2 may be configured to output video signals in synchronization with audio signals.

As an alternative to the audio signal processing apparatus including the media playback unit 15 and realizing a function for playing back recording media or a function for receiving broadcast signals, for example, an audio signal processing apparatus according to an embodiment of the present invention may be configured as an amplifier or the like so that an audio signal played back (received) from the outside can be received and a delay time adjustment based on a measured delay time can be performed on the received audio signal.

It should be understood by those skilled in the art that various modifications, combinations, sub-combinations and alterations may occur depending on design requirements and other factors insofar as they are within the scope of the appended claims or the equivalents thereof.

What is claimed is:

1. A sound measuring apparatus for measuring a sound-arrival delay time from a speaker to a microphone on the basis of a result obtained by outputting a signal from the speaker and picking up the signal using the microphone, the sound measuring apparatus comprising:

control means for performing control so that a test signal is expanded in a time axis to produce a time-expanded test signal, the time-expanded test signal being output from the speaker; and delay time measuring means for measuring an expansion-based delay time based on a time difference between the test signal and a signal obtained from the microphone representative of the time-expanded test signal and subsequently time compressed, and deriving the sound-arrival delay time from the time difference, wherein:

the test signal comprises a time stretched pulse signal;

the delay time measuring means obtains a downsampled time stretched pulse signal by downsampling the time-expanded test signal that is picked up by the microphone according to an expansion factor by which the time stretched pulse signal is expanded, and measures a first delay time on the basis of a time difference between an impulse response that is obtained from the downsampled time stretched pulse signal and an impulse signal that the test signal is based on; and the delay time measuring means multiplies the first delay time by the expansion factor to obtain the sound-arrival delay time as the expansion-based delay time.

2. The sound measuring apparatus according to claim 1, wherein the control means performs control so that the test signal is expanded in the time axis and output by successively outputting values of the test signal stored as data a plurality of predetermined times.

3. The sound measuring apparatus according to claim 1, wherein:

the delay time measuring means further measures a normally measured delay time on the basis of a time difference between a normally output test signal that is output from the speaker without being expanded in the time axis and a received test signal obtained by detecting the normally output test signal using the microphone; and the delay time measuring means determines the sound-arrival delay time on the basis of the normally measured delay time and the expansion-based delay time.

4. A sound measuring method for measuring a sound-arrival delay time from a speaker to a microphone on the basis of a result obtained by outputting a signal from the speaker and picking up the signal using the microphone, the sound measuring method comprising the steps of:

expanding a test signal in a time axis and outputting the expanded test signal from the speaker; and measuring an expansion-based delay time based on a time difference between the test signal and a signal obtained from the microphone representative of the expanded test signal and subsequently time compressed, and deriving the sound-arrival delay time from the time difference, wherein the test signal comprises a time stretched pulse signal;

the measuring further comprises obtaining a downsampled time stretched pulse signal by downsampling the expanded test signal that is picked up by the microphone according to an expansion factor by which the time stretched pulse signal is expanded, and measuring a first delay time on the basis of a time difference between an impulse response that is obtained from the downsampled time stretched pulse signal and an impulse signal that the test signal is based on; and the measuring further comprises multiplying the first delay time by the expansion factor to obtain the sound-arrival delay time as the expansion-based delay time.

5. An audio signal processing apparatus having a sound measuring function for measuring a sound-arrival delay time from a speaker to a microphone on the basis of a result obtained by outputting a signal from the speaker and picking up the signal using the microphone, the audio signal processing apparatus comprising:

control means for performing control so that a test signal is expanded in a time axis to produce a time-expanded test signal, the time-expanded test signal being output from the speaker; and delay time measuring means for measuring an expansion-based delay time based on a time difference between the test signal and a signal obtained from the microphone representative of the time-expanded test signal and subsequently time compressed, and deriving the sound-arrival delay time from the time difference; and delay time adjusting means for adjusting a delay time of an audio signal to be output from the speaker according to the sound-arrival delay time obtained by the delay time measuring means, wherein the test signal comprises a time stretched pulse signal;

the delay time measuring means obtains a downsampled time stretched pulse signal by downsampling the time-expanded test signal that is picked up by the microphone according to an expansion factor by which the time stretched pulse signal is expanded, and measures a first delay time on the basis of a time difference between an impulse response that is obtained from the downsampled time stretched pulse signal and an impulse signal that the test signal is based on; and the delay time measuring means multiplies the first delay time by the expansion factor to obtain the sound-arrival delay time as the expansion-based delay time.

6. A sound measuring apparatus for measuring a sound-arrival delay time from a speaker to a microphone on the basis of a result obtained by outputting a signal from the speaker and picking up the signal using the microphone, the sound measuring apparatus comprising:

a control unit that performs control so that a test signal is expanded in a time axis to produce a time-expanded test signal, the time-expanded test signal being output from the speaker; and a delay time measuring unit that measures an expansion-based delay time based on a time difference between the test signal and a signal obtained from the microphone representative of the time-expanded test signal and subsequently time compressed, and deriving the sound-arrival delay time from the time difference, wherein the test signal comprises a time stretched pulse signal;

the delay time measuring unit obtains a downsampled time stretched pulse signal by downsampling the time-expanded test signal that is picked up by the microphone according to an expansion factor by which the time stretched pulse signal is expanded, and measures a first delay time on the basis of a time difference between an impulse response that is obtained from the downsampled time stretched pulse signal and an impulse signal that the test signal is based on; and the delay time measuring unit multiplies the first delay time by the expansion factor to obtain the sound-arrival delay time as the expansion-based delay time.

7. An audio signal processing apparatus having a sound measuring function for measuring a sound-arrival delay time from a speaker to a microphone on the basis of a result obtained by outputting a signal from the speaker and picking up the signal using the microphone, the audio signal processing apparatus comprising:

a control unit that performs control so that a test signal is expanded in a time axis to produce a time-expanded test signal, the time-expanded test signal being output from the speaker; and a delay time measuring unit that measures an expansion-based delay time based on a time difference between the test signal and a signal obtained from the microphone representative of the time-expanded test signal and subsequently time compressed, and deriving the sound-arrival delay time from the time difference; and a delay time adjusting unit that adjusts a delay time of an audio signal to be output from the speaker according to the sound-arrival delay time obtained by the delay time measuring unit, wherein the test signal comprises a time stretched pulse signal;

the delay time measuring unit obtains a downsampled time stretched pulse signal by downsampling the time-expanded test signal that is picked up by the microphone according to an expansion factor by which the time stretched pulse signal is expanded, and measures a first delay time on the basis of a time difference between an impulse response that is obtained from the downsampled time stretched pulse signal and an impulse signal that the test signal is based on; and the delay time measuring unit multiplies the first delay time by the expansion factor to obtain the sound-arrival delay time as the expansion-based delay time.

* * * * *